US010731514B2

(12) United States Patent
Auret

(10) Patent No.: US 10,731,514 B2
(45) Date of Patent: Aug. 4, 2020

(54) METHOD OF FLUID EXCHANGE AND SEPARATION APPARATUS

(71) Applicant: Great Southern Motor Company Pty. Ltd., Kirwan, Townsville, Queensland (AU)

(72) Inventor: Derek Auret, Kirwan (AU)

(73) Assignee: GREAT SOUTHERN MOTOR COMPANY PTY. LTD., Townsville, Queensland (AU)

( * ) Notice: Subject to any disclaimer, the term of this patent is extended or adjusted under 35 U.S.C. 154(b) by 73 days.

(21) Appl. No.: 16/068,099

(22) PCT Filed: Dec. 24, 2016

(86) PCT No.: PCT/AU2016/051294
§ 371 (c)(1),
(2) Date: Jul. 3, 2018

(87) PCT Pub. No.: WO2017/117624
PCT Pub. Date: Jul. 13, 2017

(65) Prior Publication Data

US 2019/0010833 A1 Jan. 10, 2019

(30) Foreign Application Priority Data

Jan. 4, 2016 (AU) ..... 2016900001
Jan. 11, 2016 (AU) ..... 2016900074
Jun. 5, 2016 (AU) ..... 2016902176

(51) Int. Cl.
*F01K 25/02* (2006.01)
*F04B 5/02* (2006.01)
(Continued)

(52) U.S. Cl.
CPC ..... *F01K 25/02* (2013.01); *F02G 1/055* (2013.01); *F04B 5/02* (2013.01); *F04B 17/03* (2013.01);
(Continued)

(58) Field of Classification Search
CPC ..... F01K 25/02; F02G 1/055; F04B 17/03
See application file for complete search history.

(56) References Cited

U.S. PATENT DOCUMENTS 4,077,221 A 3/1978 Maeda
4,747,271 A * 5/1988 Fischer ..... F01B 29/12 60/650
(Continued)

FOREIGN PATENT DOCUMENTS

WO 2015010021 A1 1/2015

OTHER PUBLICATIONS

ISA Australian Patent Office, Written Opinion Issued in Application No. PCT/AU2016/051294, dated Mar. 23 2017, WIPO, 7 pages.

*Primary Examiner* — Shafiq Mian
(74) *Attorney, Agent, or Firm* — Alleman Hall Creasman & Tuttle LLP

(57) ABSTRACT

The invention relates to a method of fluid exchange using a separation apparatus, in controlled fluid communication with an inlet and an outlet. Opening of the inlet enables fluid communication with the separation apparatus, exchange of fluid (a "first fluid exchange") of a first volume of fluid, sealing/closing preventing further fluid communication. Opening of the outlet to be in fluid communication with the separation apparatus enables exchange of fluid (a "second fluid exchange") through the open outlet of a second volume of fluid. In the method, the outgoing volume of fluid and the incoming volume of fluid in each exchange are substantially similar and there is substantially no loss of pressure by virtue
(Continued)

of the exchange. The invention also relates to a separation apparatus, including a separation chamber and a control system.

43 Claims, 15 Drawing Sheets

(51) Int. Cl.

| | |
|---|---|
| ***F02G 1/055*** | (2006.01) |
| ***F04B 17/03*** | (2006.01) |
| ***F04B 49/06*** | (2006.01) |
| ***F04B 23/04*** | (2006.01) |
| *F02G 1/043* | (2006.01) |

(52) U.S. Cl.
CPC ..... *F04B 23/04* (2013.01); *F04B 49/065* (2013.01); *F02G 1/043* (2013.01); *F02G 2254/00* (2013.01); *F04B 2205/063* (2013.01)

(56) References Cited

U.S. PATENT DOCUMENTS

| | | | | |
|---|---|---|---|---|
| 5,638,684 | A | 6/1997 | Siegel et al. | |
| 6,423,152 | B1 * | 7/2002 | Landaas | B08B 9/0325 134/10 |
| 9,341,138 | B2 * | 5/2016 | Russo | B60K 6/24 60/516 |
| 2010/0133903 | A1 | 6/2010 | Rufer et al. | |
| 2011/0006006 | A1 * | 1/2011 | MacHarg | B01D 61/025 210/652 |
| 2011/0219763 | A1 | 9/2011 | McBride et al. | |
| 2014/0000251 | A1 * | 1/2014 | McBride | F01B 23/00 60/327 |
| 2015/0211440 | A1 * | 7/2015 | Joffroy | F04B 25/00 60/526 |
| 2015/0285183 | A1 * | 10/2015 | Vatne | F02G 1/053 60/521 |

* cited by examiner

METHOD OF FLUID EXCHANGE AND SEPARATION APPARATUS

FIELD OF THE INVENTION

The present invention relates to a method of fluid exchange. The invention also relates to a separation apparatus, and use with a method of fluid exchange.

Priority is claimed of Australian provisional patent application Nos: 201600001 (4 Jan. 2016), 2016900074 and 2016902176, the text of each of which is incorporated herein by reference.

BACKGROUND OF THE INVENTION

Use of energy exchange, such as heat exchange to drive a piston has been well-known for many years. The basic principle, in its simplest form, is to use the difference between a hot and cold area to cause a shift of "working fluid", to create energy. The movement can then be used to drive a piston such as in an engine, commonly known as a "Sterling Motor". The precise manner of use of heat exchange engine has evolved over the years to include use of a shield or displacer that moves between locations to assist in the movement of the energy, then used to drive a piston or the like. The principles utilised are applicable to a wide range of industries, with a wide range of applications.

In recent times there has been a desire to use significantly higher pressures within these types of engines, typically 200 bar or more. To accommodate these significantly higher pressures the wall thickness of the vessels must be very thick, typically 30 millimetres or more of usually iron. Thin walled vessels are not suitable to contain the high pressures and must be very thick. There are further problems with the thick walls necessitated by the high pressures, as the heating and cooling is impeded by the wall thickness, heat cannot get in and cooling cannot get out. Subsequently the exchange of energy is slowed and works inefficiently.

Therefore, there has been for a very long period of time a strong frustration with the conventional design of these types of motors or devices. The thickness of the wall is necessary for the high pressures but limits the flow of energy in and out of the device, or the ability to create areas of cold and hot. It is also very difficult to make a workable motor with necessary thick vessel walls, if the input temperature is to be lower. The problem has been clear for a long time and much thought has been put into how could there be an improvement but no solution or even partial solution has been found.

The inventor, in a desire to improve the design of these types of engines or devices, has developed an inventive method and apparatus which is likely to introduce a significant change to the nature of these types of motor in the future. The invention uses a separated fluid exchange, such as through use of a separation chamber or gated area to separate the heating from the other parts of the sealed system. In this manner the heating part can be thin walled for good heat exchange, and the other parts of the apparatus adapted for high pressures with the necessary thick walls. Once the invention is known by people in the relevant industries, of which there are many, it is considered that it will rapidly be adopted as the standard.

Clearly, the invention is applicable in a great many fields and applications, only some of which are discussed here as examples to the breadth of application. Where a similar form of energy or heat exchange or motor is used the principles of the invention may similarly be applied, as would be understood by a person skilled in the art. It is not intended that the invention be in any way limited to the examples given, these are to illustrate the significant uses available for the invention. The inventive method and fluid exchange is equally applicable to a refrigeration system.

Throughout the specification and claims the term "exchange" is used to be indicative of the movement of fluid in the system. Typically this will be the movement of a heated fluid from the source of the heat towards a cooling area, as would be readily understood by a person skilled in the art. The term "exchange" in some circumstances may be a more loose use of the term, to indicate movement.

For clarity, any prior art referred to herein, does not constitute an admission that the prior art forms part of the common general knowledge in Australia or elsewhere.

It is an object of the present invention to provide a method of fluid exchange that at least ameliorates one or more of the aforementioned problems of the prior art. It is a further object of the invention to provide a separation apparatus for fluid exchange, that at least ameliorates one or more of the aforementioned problems of the prior art.

DISCLOSURE OF THE INVENTION

Accordingly, the invention provides a method of fluid exchange using a separation apparatus, the separation apparatus being able to be in controlled fluid communication with an inlet and an outlet, the method including the following steps:

a) opening of the inlet enabling fluid communication with the separation apparatus;

b) exchange of fluid (a "first fluid exchange") is made through the open inlet of a first volume of fluid;

c) a sealing/closing of the inlet to prevent further fluid communication with the separation apparatus;

d) an opening of the outlet to be in fluid communication with the separation apparatus; and e) exchange of fluid (a "second fluid exchange") is made through the open outlet of a second volume of fluid, wherein the outgoing volume of fluid and the incoming volume of fluid in each exchange are substantially similar and there is substantially no loss of pressure by virtue of the exchange.

The method may also include the following step:
controlling the opening or closing of the inlet or outlet.

The method may also include the following step:
opening or closing of valves.

The method may also include the following step:
moving a plunger arrangement up or down.

The method may also include the following step:
equalisation of pressure between the fluid in the separation apparatus, and each of the inlet or outlet fluids separately before communication.

The method may also include the following step:
periodic adjustment of the volume of fluid between a first and second fluid location through use of compression or decompression.

The method may also include the following step:
heating or cooling of the fluid at a first fluid location or second fluid location or both fluid locations, before exchange.

The method may also include the following step:
monitoring of temperature or pressure at fluid locations associated with the inlet or outlet.

The method may include where the passing of the cold influence or hot influence is in effect the charging or discharging of a thermal sink or battery.

The method of fluid exchange may be used for any suitable purpose. Preferably, the method is utilised to create movement energy, such as a heat motor. The method of fluid exchange may be used as part of a heat motor. The method of fluid exchange may be used as part of a refrigeration system. The method of fluid exchange may be used in any suitable means where temperature or pressure differences within the fluid may be used to create usable energy or movement.

The fluid may be any suitable fluid. The fluid may be break fluid, water, or any liquid phase thermal transfer fluid. The fluid is important as a liquid for exchange in the invention. However, the liquid may phase change to gas after exchange. Importantly, the invention does not apply to vapour systems or where a compression device compresses a gas just prior to exchange.

The exchange may be any suitable movement of fluid. The exchange may take any suitable form. The exchange may be movement of fluid of one temperature towards an area of another temperature. For example, where the invention is used to drive a piston arrangement heating to fluid which may be exchanged for cooler fluid of the same volume in order that the fluid may impart the heat to the "working fluid" of a heat motor, to create movement. There are various and multiple forms of the invention, however common to them all is the separation of fluid exchange to maintain that the volume of fluid is the same, and the pressure increase within the system is negligible. The exchange is preferably an actual movement of fluid without mixing. The exchange is preferably, the movement of a fluid of one temperature to be exchanged with fluid of another temperature. In other forms of the invention other differences in the fluid are considered.

Preferably, in some forms of the invention the fluid exchange forms a circuit. The circuit may operate such as to form a continuous, Figure of 8 type, fluid exchange as would be useful in some embodiments.

The steps of the method may be performed in any suitable order. Additional steps may be included in the method, as described further below.

Accordingly, the invention provides, a separation apparatus for fluid communication with an inlet and an outlet, for fluid exchange, the separation apparatus including:

- a separation chamber able to be in fluid communication with an inlet and able to be in fluid communication with an outlet;
- a control system for controlling the opening and closing of the inlet and outlet to enable fluid exchange;

wherein, the control system opens the inlet whereby fluid communication may occur with the separation chamber and then is sealed closed, and the control system opens the outlet whereby fluid communication may occur with the separation apparatus, and further wherein the outgoing volume of fluid and the incoming volume of fluid in each exchange are substantially the same and there is substantially no loss of pressure by virtue of the exchange.

Preferably, the separation apparatus of the method is the separation apparatus of the invention as described in any of its forms or variants.

The separation apparatus may be used for any suitable application. Preferably, the separation apparatus is used with the method of the invention for a heat motor. The separation apparatus and method of the invention may also be used with a refrigeration apparatus. The separation apparatus may be used for any suitable purpose. The separation apparatus is preferably used with the method of the invention to enable a thin walled heating of the fluid and exchange to occur of the hot fluid whereby the hot fluid is used to act on "working fluid" of a heat motor working beneficially at high pressures.

The fluid communication may take any suitable form. Preferably, the fluid communication is the movement of a discrete volume of fluid into the separation apparatus. The fluid communication may be through the fluid being drawn under natural forces in a particular direction. The fluid communication may be driven or forced flow, in other forms of the invention.

The inlet may take any suitable form whereby fluid may be able to enter the separation apparatus. The inlet may be a tube or pipe arrangement. There may be more than one inlet for the separation apparatus. Each inlet may be controlled independently. The inlet may control one or means of opening or closing the inlet. Preferably, the inlet may include one or more valve. The inlet may be include a one-way valve. The one-way valve may prevent or enable fluid communication during high pressures. The inlet may include valves controllable by a control system. In other forms of the invention other controls may be used turn a valve in the inlet on or off, to prevent or enable fluid communication. Preferably, the control system may be used to turn a valve on or off to enable fluid communication of the inlet.

The outlet may take any suitable form whereby fluid may be able to enter the separation apparatus. The outlet may be a tube or pipe arrangement. There may be more than one outlet for the separation apparatus. Each outlet may be controlled independently. The outlet may control one or more means of opening or closing the outlet. Preferably, the outlet may include one or more valve. The outlet may be include a one-way valve. The one-way valve may prevent or enable fluid communication during high pressures. The outlet may include valves controllable by a control system. In other forms of the invention other controls may be used turn a valve in the outlet on or off, to prevent or enable fluid communication. Preferably, the control system may be used to turn a valve on or off to enable fluid communication of the outlet.

The fluid exchange may be the controlled movement of fluid of one temperature towards an area of another temperature. For example, where the invention is used to drive a piston arrangement heating to fluid which may be exchanged for cooler fluid of the same volume in order that the fluid may impart the heat to the "working fluid" of a heat motor, to create movement. The heating or cooling influence may take any suitable form, and influence in any suitable manner.

Preferably, the separation apparatus includes a separation chamber. The separation chamber may take any suitable form. There may be in other forms of the invention multiple parts to the separation chamber. Most preferably, the separation chamber enables the controlled and separate fluid exchange between the inlet and outlet without a substantial change in pressure of the fluid in the system.

The separation chamber may be adapted to work at high pressures. The separation chamber may be suitable to contain fluid at high pressures. The separation chamber may include a thick wall. Preferably, the thick wall is suitable to contain pressures of 200 to 500 bar. Preferably, the thick wall is 30 millimetres or thicker. The thick wall may be made of steel. The thick wall may take any suitable form.

Preferably the separation apparatus includes a control system for controlling the opening and closing of the inlet and outlet to enable fluid communication. The control system may take any suitable form. Preferably, the control system enables a discrete volume of fluid to enter the separation chamber. Most preferably, the first fluid exchange into the separation apparatus occurs by opening of the inlet by the control system. Most preferably, the second fluid exchange into the separation apparatus occurs by opening of the outlet by the control system. Preferably, fluid exchange of the outlet and inlet occur separately. The control system may include a computer controlled system. The control system may include any one or more chosen from the group: Arduino unit; relay board; power source; and various suitable connections. Any suitable microprocessor control may be used to control operation of the separation apparatus to perform the method. Preferably, the control system includes means to control the fluid communication of the inlet and separation of the fluid communication of the outlet. The control system may control any one or more parts of the separation apparatus. The control system may include valves and changes in pressure in the system enable opening or closing of an outlet or inlet in response to changes in the pressure.

Preferably, the separation apparatus includes a plunger arrangement. Preferably, the plunger arrangement acts on fluid within the separation chamber. The plunger may be a displacer of any suitable form. The plunger arrangement may be adapted to fit across the width of the separation chamber. Preferably, the plunger arrangement is configured to cause movement of a suitable volume of fluid to exchange. Preferably, the plunger arrangement is adapted to move exactly a suitable volume of fluid to be exchanged. Preferably, the plunger arrangement determines the volume of fluid to be exchanged. Preferably, the plunger arrangement is controlled by the control system. The control system may operate the plunger arrangement directly. The plunger arrangement may be controlled to move up and down according to predetermined instructions. The control system may cause the plunger arrangement to be depressed in response to sensor information within the system, in some forms of the invention.

Preferably, there is a first location of fluid and a second location of fluid. Preferably, there is a temperature difference between the first location of fluid and the second location of fluid. Preferably, in one form of the invention the first location of fluid may be acting upon by heat so that the fluid heats, when compare to other fluid in the system. Preferably, the first location of fluid is a ambient pressure environment, for maximised easy heating. Preferably, the first location has a thin wall suitable for rapid heating of the fluid contained therein. In other forms of the invention the first location may be a cooling head.

The first location may be any suitable location. Preferably, the first location of fluid is a heating vessel. The heating vessel may take any suitable form. The heating vessel may include an accommodation tube to allow for expansion of the fluid at high temperatures. In some forms of the invention a plurality of heating vessels are included. Preferably, numerous heating vessels are included for rapidly heating the fluid. Preferably, 18 heating vessels may be included arranged to heat fluid very rapidly before exchange. A plurality of heating vessels are arranged for rapid heating of the fluid prior to exchange. Any kind of heat exchange, or exchange may be used for rapid heating prior to exchange.

The second location of fluid may be any suitable location. Preferably, the second fluid location is associated with a heat motor, or similar apparatus. A cooling head may instead be associated with the second fluid location. Preferably, the second location is adapted to withstand high pressures. Preferably, the second location includes a thick wall to assist to withstand the high pressures. The high pressures may be greater than 200 bar. The high pressures may be 200 to 500 bar. The high pressures may be any suitable high pressures. The thick wall may be a 30 millimetre thick steel wall.

Most preferably, the second location of fluid is a location whereby the temperature of the fluid can influence another medium across a wall. Preferably, the medium is fluid separated from the fluid of the second location by a wall. Preferably, there is no pressure difference between the fluid of the second location and the fluid across the wall. Preferably, the second location of fluid is at high pressure contained within a suitable thick wall, similar to the pressure of the fluid across the wall. Preferably, the fluid of the second location is able to influence the "working fluid" of a motor or similar apparatus to generate movement across the wall. Preferably, the wall is a thin wall that enables easy transfer of a temperature difference. Preferably, the second location of fluid is such that it can influence a separate body of fluid. The influence may be to heat or cool depending on the nature of the associated apparatus. Most preferably, the second location of fluid can influence a fluid to generate movement such as a heat motor. In this case hot fluid heated by the heating vessel may be exchanged with the separation apparatus to influence working fluid through a thin wall to run the motor. In other uses of the invention the temperature may be different, such as cooling in refrigeration systems.

Preferably, when a controlled volume of fluid passes between the first location of fluid and the separation chamber a similar volume of fluid passes in the reverse direction for a zero net volume exchange. Similarly, when a controlled volume of fluid passes between the separation chamber and the second fluid location, a similar volume of fluid passes in the reverse direction for a zero net volume exchange.

Preferably, the wall is a thin wall that enables ready transfer of temperature and the second location is otherwise contained in a thick wall adapted to enable the working fluid and motor or similar to operate and high pressures. Preferably, the thin wall has a zig-zag formation to assist in transfer of temperature difference. The thin wall may take any suitable form. Preferably, where the thin wall at the second location of fluid is of a zig-zag formation a displacer within the heat motor working fluid on the other side to the second location of fluid corresponds with the zig-zag form of the thin wall. In other forms of the invention a thin walled heat exchanger could replace the thin wall. In some alternative forms of the invention the thin wall may be omitted or replaced.

Most preferably, the control system causes a volume of fluid to exchange from the first fluid location with the separation chamber and in a second exchange from the separation chamber to the second location. Preferably, the fluid of the second exchange can influence further fluid across a wall to run a motor.

The control system may control the opening and closing of valves and use of the plunger arrangement whereby a substantially similar volume of fluid is exchanged first from the heating vessel with the separation chamber and then to the second fluid location where the heated fluid can be used. Clearly, for refrigeration the arrangement would work the same but with the heat direction being different.

In one preferred form of the invention there are a pair of inlets and a pair of outlets to the separation apparatus. Fluid exchange preferably occurs between one pair of an inlet and an outlet associated with a location of fluid, followed by a separate fluid exchange with a different location of fluid and a different inlet and outlet. In this form of the invention Preferably, sensors are included. The sensors may be temperature sensors. The sensors may be pressure sensors. Preferably, the control system includes means to read the sensors.

Preferably, a temperature sensor is included at the first fluid location. Preferably, a temperature sensor is included at the second fluid location. Preferably, a temperature sensor is included at both the first and second fluid location to monitor the relative temperatures. Preferably, a pressure sensor is included at the first fluid location. Preferably, a pressure sensor is included at the second fluid location. Preferably, a pressure sensor is included at both the first and second fluid location to monitor the relative pressures at the two fluid locations. Safety controls and upper limits may be included to respond to high pressures or temperatures as appropriate.

Pressure levels in the fluid at the second location of fluid in particular are monitored. In some forms of the invention some pressure adjustment in parts of the apparatus may be achieved by use of decompressor and or compressor device. Preferably, an electric hydraulic ram is included in the control system, to adjust the pressure. Volume redistribution may be included to keep the thin wall intact, rather than ballooned left or right. Preferably, volume equalisation occurs to maintain the stability of the thin wall or where present a thin walled heat exchanger.

A pressure absorbing device may be included. For example a spring arrangement may be included in the separation apparatus as an energy efficient means to absorb pressure.

Preferably, the method is used as a means to enable efficiently heating of fluid and transfer of the heat to drive a heat motor, similar to a Stirling engine.

Preferably, the volume of fluid exchanges is substantially the same. Preferably, the volume of fluid exchanged is exactly the same.

Preferably, the separation apparatus of the method is the separation apparatus of the invention in any of its forms or variants.

Accordingly, the invention provides a separation apparatus including:

- a first fluid location or chamber to which heat may be applied to fluid contained therein;
- a second fluid location or chamber adapted to operate at high pressures;
- a separation means in controlled communication with the fluid of the first fluid location or chamber and separately the second fluid location or chamber;
- a control system for control of the communication of the fluid between the first fluid location or chamber and the separation means and the separation means and the second fluid location or chamber, wherein, a staged and controlled process enables heated fluid from the first fluid location or chamber to pass via the separation means to exchange heat across a wall within the second chamber to a further fluid, the second chamber able to operate at high pressures.

In other forms of the invention the heating may be replaced by cooling.

Accordingly, the invention provides in a variation a method of fluid exchange using a separation apparatus, the separation apparatus being able to be in controlled fluid communication with an inlet and an outlet, the method including the following steps:

a) opening of the inlet enabling fluid communication from a first fluid location, to which heat may be applied to rapidly heat the fluid, with the separation apparatus;

b) exchange of hot fluid (a "first fluid exchange") is made through the open inlet of a first volume of fluid;

c) a sealing/closing of the inlet to prevent further fluid communication with the separation apparatus;

d) an opening of the outlet to be in fluid communication with the separation apparatus; and e) exchange of fluid (a "second fluid exchange") is made through the open outlet of a second volume of fluid, to a second fluid location that may operate at high pressures, wherein the outgoing volume of fluid and the incoming volume of fluid in each exchange are substantially similar and there is substantially no loss of pressure by virtue of the exchange, and the hot fluid at the second fluid location may influence the working fluid of a heat motor arrangement to generate movement.

Accordingly, the invention provides, a separation apparatus for fluid communication with an inlet and an outlet, for fluid exchange, the separation apparatus including:

- a separation chamber able to be in fluid communication between a first fluid location suitable for heating the fluid and an inlet and able to be in fluid communication between a second fluid location operating at high pressure an outlet;
- a control system for controlling the opening and closing of the inlet and outlet to enable fluid exchange between the first fluid location and the separation chamber and the separation chamber and the second fluid location;

wherein, the control system opens the inlet whereby fluid communication may occur with the separation chamber and then is sealed closed, and the control system opens the outlet whereby fluid communication may occur with the separation apparatus, and further wherein the outgoing volume of fluid and the incoming volume of fluid in each exchange are substantially the same and there is substantially no loss of pressure by virtue of the exchange, and heat applied at the first fluid location may be exchanged to the second fluid location and used to influence the working fluid of a heat motor to generate energy.

Accordingly, the invention further provides a method of use of a separation apparatus including the following steps:

1. Power connection 79 for 10 seconds, to move plunger 52 down (pump);
2. Power connection 77 for 5 seconds, close valve 54 in pipe 38 between vessels 30 and 32;
3. Power connection 75, until the reading from connection 69 of pressure sensor 48*a* in vessel 28 and connection 71 of 48*b* in vessel 30, match, compress;
4. Power connection 73 for closed valve 56 for 5 seconds, to open between vessels 28 and 30;
5. Power connection 80 for 10 seconds, to raise plunger 52 up(pump);
6. Power connection 74 for 5 seconds, to close value 56 between vessels 28 and 30;
7. Power connection 76, until the reading from sensor 71 pressure sensor 48*b* in vessel 30=zero pressure, decompress;
8. Power connection 77 for 5 seconds, open valve 54 between vessels 28 and 30; and
9. Go to start.

Preferably, the method is used in a cyclical operation.

Separately, preferably, every hour maintenance actions may be undertaken to keep the system working well. These may be any suitable actions. The actions may include to bring the pressure of one or more valve back to a known constant.

Preferably, for the method, when there is an exchange from a low pressure to a high pressure that that part of the exchange is a liquid phase transaction eg not a vapour system.

INDUSTRIAL APPLICABILITY

The separation apparatus can be manufactured industrially, in parts, and assembled for use in a multitude of commercial or industrial applications, through use of the method of fluid exchange.

BRIEF DESCRIPTION OF THE DRAWINGS

The invention will now be described in connection with non-limiting preferred embodiments with reference to the accompanying drawings, in which.

DETAILED DESCRIPTION OF THE INVENTION INCLUDING A BEST MODE

Figure 1:
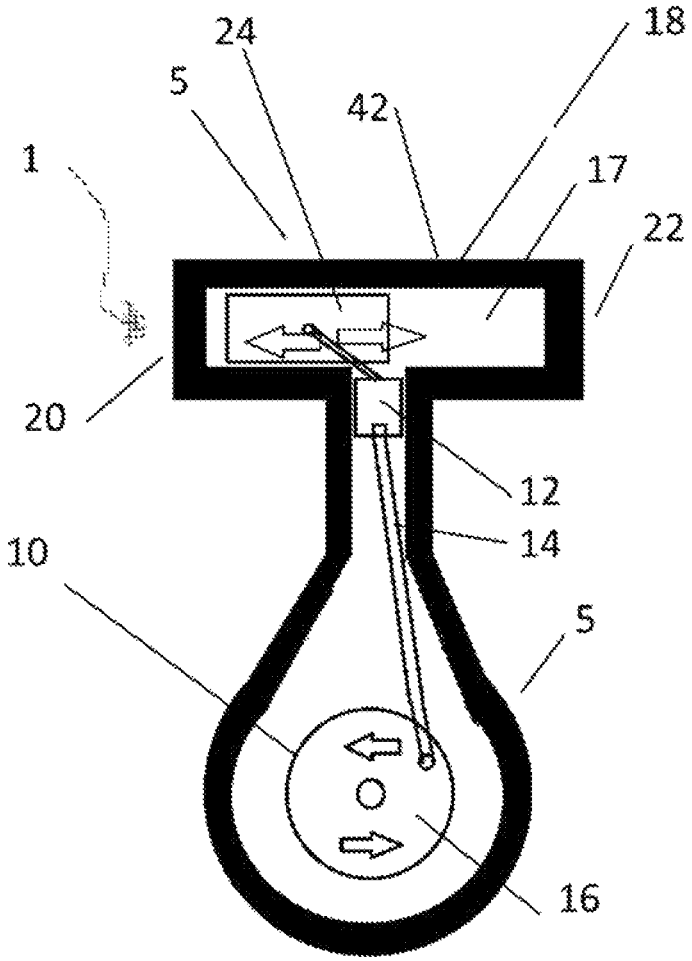
FIGURE 1 (PRIOR ART)
FIG. 1 is a schematic diagram of a PRIOR ART high pressure Stirling engine of a known form, including a thick wall about the entire sealed system.

Throughout the schematics drawings arrows may be used to indicate the direction of movement for ease of understanding. Some labels and terms have been used in the drawings to assist with the understanding, such as open and closed valves and active and inactive pumps, also to facilitate the understanding of the Figures.

Referring to FIG. 1, an example is given of a prior art high pressure version of the "Stirling Engine" 1. A Stirling-cycle engine is a machine which operates on a closed regenerative thermodynamic cycle, with periodic compression and expansion of a gaseous working fluid at different temperature levels. Since the Stirling engine is a closed cycle, it contains a fixed mass of gas called the "working fluid", most commonly air, hydrogen or helium.

As illustrated in FIG. 1, to cope with the very high pressures the entire prior art apparatus 1 is encapsulated in a very thick wall 5, of approximately 30 millimetres thick in iron, as is indicated by thick black line. Throughout the drawings a thick black line indicates the thick wall being used, compared to a thin line which represents a standard wall, not generally suitable for a high pressure environment.

Generally labelled 10 is a piston arrangement which is to be driven by the heat displacement arrangement, of a known form. Piston arrangement 10 is also contained within thick wall 5, in order that high pressures may be contained within the apparatus. Piston arrangement 10 has piston 12, attached to arm 14 connected to shaft 16 via rod 15. As piston 12 is caused to move up and down the movement likewise moves arm 14 and rod 14 to rotate shaft 16, in the usual manner. The action on shaft 16 can then be used to drive other parts of machinery, such as a vehicle or industrial production.

Piston 12 is caused to move up and down due to displacement of "Working Fluid" 17 through heat exchange within chamber 18. Chamber 18 has a cooling end 20 and a heating end 22, in the usual manner.

Heat is applied at the heating end 22 through a flame or other heat so that the working fluid 17 within chamber 18 heats at that end, increasing the internal pressure, necessitating thick walls to prevent cracking or damage. Unfortunately, thick wall 5 acts against the rapid heating as the wall is very thick as is needed to contain the pressures, but then it is difficult for the heat to penetrate. Cooling can occur at end 20, reducing the pressure, and cooling should occur through thick wall 5, but is slowed. Displacer 24 is moved to assist in the heat exchange of working fluid 17, which in turn causes the up and down movement of piston 12. In turn piston 12, moves arm 14 and rod 15, rotating shaft 16 to cause motor action.

In the prior art the high pressure is safely maintained, but the heat exchange to heat the working fluid is strongly inhibited by the thick wall and so the motor does not work at all well. The problem of the prior art has been long established with many attempts to try to solve this problem, none successfully.

Figure 2:
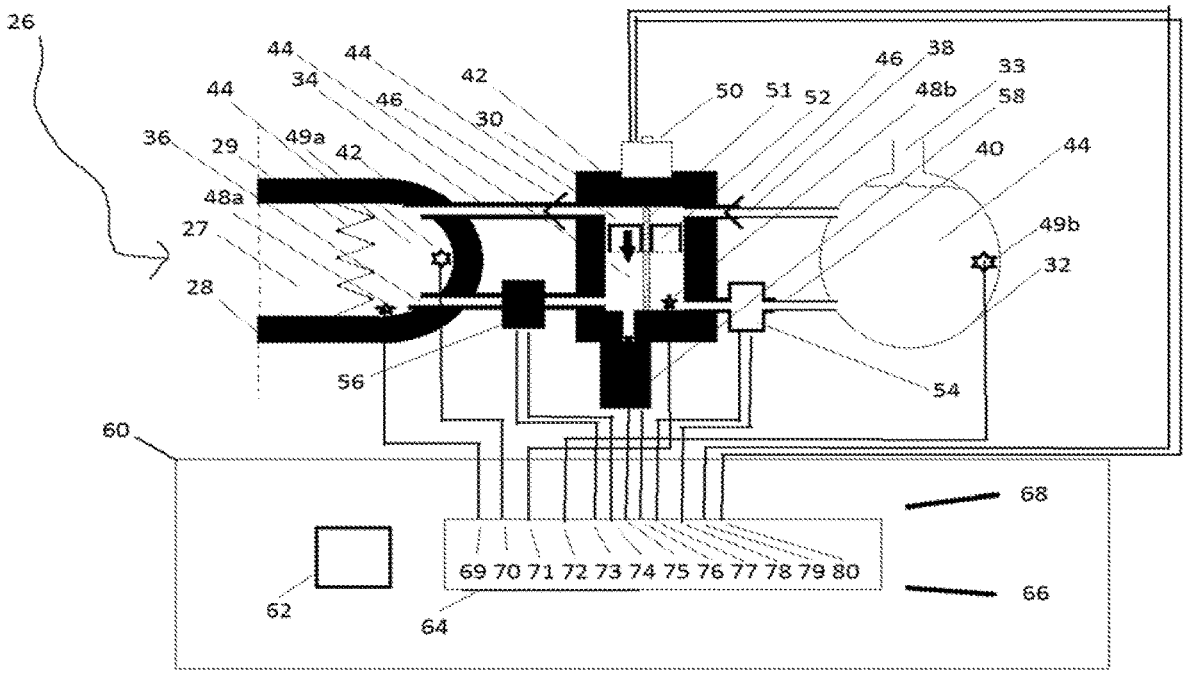
FIG. 2 is a schematic side view of a heat motor apparatus according to a first preferred embodiment of the invention, showing the first stage of heat exchange.
Figure 3:
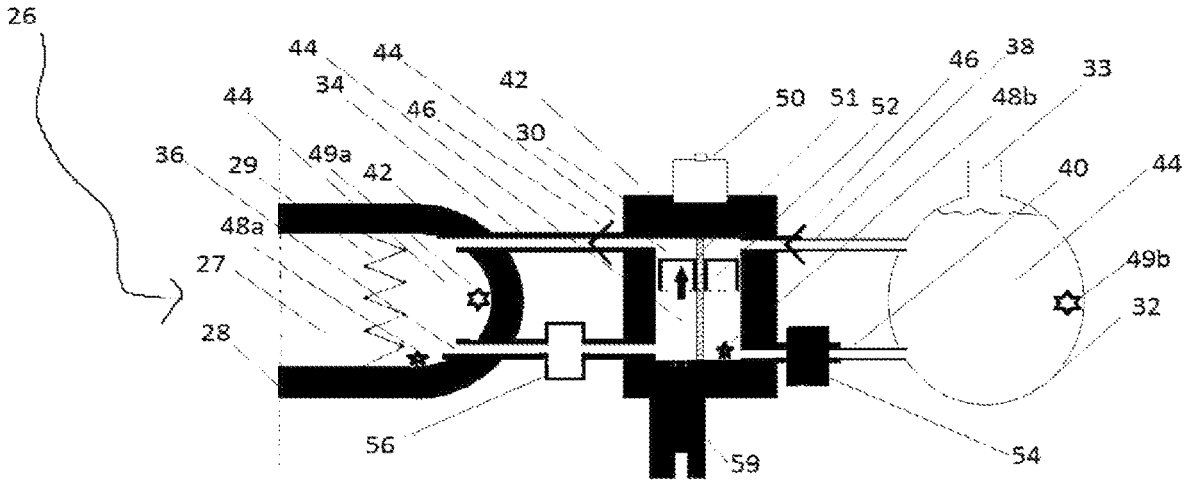
FIG. 3 is a schematic side view of the heat motor apparatus of FIG. 1, showing the second stage of heat exchange.
Figure 4:
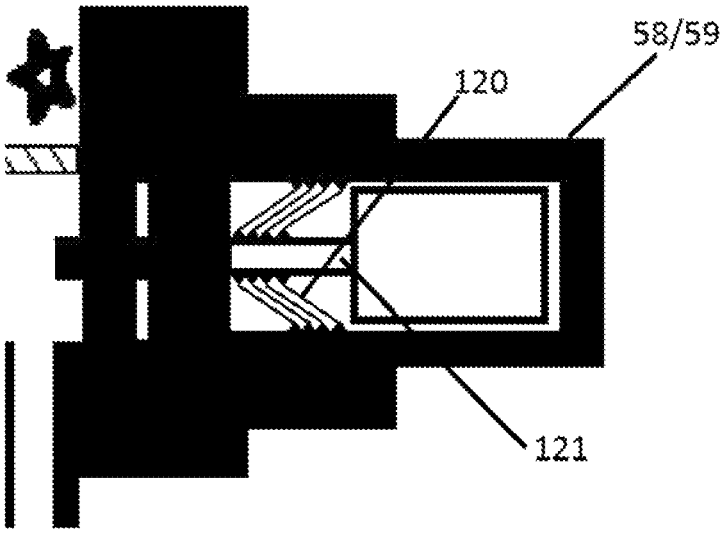
FIG. 4 is a detailed schematic front view of part of FIG. 7 below, a second preferred embodiment of the invention.

Referring to FIGS. 2 and 3, a first preferred embodiment of the invention will be described, as a significant improvement over the prior art including many inventive and beneficial features. The representations are highly stylised schematics for ease of illustration, where heat motor apparatus 26, is used with "Working Fluid" 27 in the part similar to end 22 of the prior art. Working fluid 27 as in the illustrated preferred embodiment is water. Other suitable fluids may be used instead depending on the particular application of the working part of the arrangement to generate usable energy and movement, or store thermal energy by heating thermal fluid for use as a battery. It is the new form of fluid exchange and heat transfer that is important here, that may be used with any suitable connected mechanism. As shown heat motor apparatus 26 would be used to drive a piston arrangement similar to as described in the prior art. The particular use of the first preferred embodiment is not intended to limit the scope of the invention. The invention relates in particular to the control and operation of the apparatus at high pressures in an improved efficiency over existing Stirling engines, and usable at high pressures. The invention is clearly applicable to a myriad of industrial and other uses where it is desired to improve the efficiency of heat exchange motor arrangements and the like, which can work at high pressure, and produce energy efficiently.

Heat motor apparatus 26 is shown including vessel 28 (including thin wall 29, which separates working fluid 27 from the rest of the arrangement), vessel 30 (for separation and control), and vessel 32 (for heating, including accommodating tube 33), each in controlled fluid communication, in series. Vessel 28 is only partially shown for ease of illustration as indicated by a dotted line. Vessel 28 is similar to end 22 of the prior art of FIG. 1 and working fluid 27 operates within this arrangement in a similar manner. A displacer similar to the displacer illustrated in FIG. 1 will be moved as described and will be adapted to have a "Zig-Zag" configuration to correspond to the "Zig-Zag" form of thin wall 29. Use of the energy/movement generated by the invention can be utilised in any suitable manner therefore. In refrigeration uses of the invention where cold is removed at vessel 32, then vessel 28 could be the cold head of a reverse "Stirling engine" of the type used in cryogenics.

Connected to the vessels for fluid communication are a series of pipes. Pipe 34 is in communication between the upper parts of vessel 30 and vessel 28. Pipe 36 is in communication between the lower part of vessel 28 and vessel 30. Pipe 38 is in communication between the upper parts of vessel 32 and vessel 30. Pipe 40 is in communication between the lower part of vessel 32 and vessel 30. Some variation in arrangement is possible, but importantly when a controlled volume of fluid passes between vessel 32 and 30, a similar volume of fluid passes in the reverse direction for a zero net volume exchange. Similarly, when a controlled volume of fluid passes between vessel 30 and 28, a similar volume of fluid passes in the reverse direction for a zero net volume exchange.

Vessels 28, 30 and 32 are not openly in fluid communication, but in controlled fluid communication to enable an inventive two-stage process to transfer thermal energy from vessel 32 to vessel 28. The separation in the process is important, because open and uncontrolled communication between the vessels would result in the loss of internal pressure in heat motor apparatus 26. Importantly, the volume of the exchange is of the same volume of fluid, both in and out of vessel 30, each exchange, occurring at different times, maintaining substantially the same volume within the system during the exchange.

Each of vessels 28 and 30 has thick wall 42 suitable to contain fluids at high pressure, between 200 and 500 bar. Vessel 32 does not include the thick wall to enable ready heating. Working fluid 27 of heat motor apparatus 26 is separated from thermal load transfer fluid 44, in this case brake-fluid, by thin wall 29 within cooling vessel 28 (indicated by a zig-zagged line). It is through this thin wall 29 that rapid heat transfer can occur from the heated fluid 44 to working fluid 27, all surrounded and contained within thick wall to contain the high pressures.

One way valves 46 are included in pipes 34 and 38, to assist in the control at pressure of thermal load transfer fluid 44 as indicated by an arrow. The method of control and use of the valves is described further below.

Thermal load transfer fluid 44 can be readily heated by action of heat on vessel 32. Neither the wall of vessel 32, nor wall 29 of vessel 28 are thick walls, and so heat exchange can readily occur, to working fluid 27. In the prior art engine of FIG. 1, using thin walls, between working fluid 17, and the applied heating or cooling, would simply not be possible, due to the very high pressure inside the thick walled vessel. The thick wall as illustrated in the prior art of FIG. 1 is 30 millimetres thick iron, suitable to contain these very high pressures, and suffers the problems of the prior art as described above therefore, of limited heat exchange.

As shown in FIGS. 2 and 3, working fluid 27, is contained in the sealed heat motor apparatus 26, and can be readily heated through action of heat on thermal load transfer fluid 44 in vessel 32. Vessel 32 does not include a thick wall, and so can be quickly and efficiently heated to input the heat energy, for example, by use of a direct flame applied to vessel 32 in the usual manner. Any suitable heat source may be used.

Referring to FIG. 2 in particular, a first phase is described where a direct flame is applied to vessel 32 which starts to heat thermal load transfer fluid 44. Fluid 44, in this case is brake-fluid, of 650 degrees Celsius boiling point, and virtually incompressible. As the virtually incompressible fluid 44, of high boiling point, starts to heat, a very small expansion in volume occurs. This expansion in volume is accommodated by accommodating tube 33 of vessel 32. Accommodating tube 33 is shown partially as tube 33 may be as long as required to accommodate any expanded fluid of the system, such as if the liquid boils. Accommodation tube 33 is useful as it relieves pressure in vessel 32 caused by expansion of the fluid contained therein.

Various sensors are included in the system as described below including pressure sensor 48*a* in vessel 28, and pressure sensor 49*b* in vessel 32. These pressures sensors are useful during the equalisation of pressures as described below as well as for safety and monitoring purposes. Temperature sensor 49*a* is included in vessel 28 and temperature sensor 49*b* is included in vessel 32. Again these temperature sensors are useful for monitoring and safety during use of the apparatus.

Motor 50 is included, and as illustrated is a stepper motor of a known form with attached rotating screw rod 51 connected to plunger 52 within central vessel 30. Activation of motor 50 causes rotating screw rod 51 to cause the depression of plunger 52 whereby hot thermal load transfer fluid 44 from vessel 32 is induced to enter vessel 30. None of fluid 44 above plunger 52, inside vessel 30 can pass against the very high pressure of vessel 28, so none passes one-way valve 46 of pipe 34 between vessels 30 and 28. Instead the hotter fluid 44 leaving vessel 32 finds itself held above plunger 52 in vessel 30. The same vertical downward movement of plunger 52 in vessel 30, moves a colder instance of fluid 44, previously obtained from vessel 28, as described below, from under plunger 52, through the open valve 54 of pipe 40 to vessel 32, where it may accumulate applied heat.

So far, in the first phase, we have applied heat to vessel 32 in the usual manner, and by certain controlled fluid communication, some of that heat has been forced, by control means, to above the plunger 52 in vessel 30. Now begins the second phase of the thermal heat transfer between vessel 32 and vessel 28.

If one were to consider the diagrammatical differences between the structure of FIG. 2 and FIG. 3, one would note that where in FIG. 2, open communication existed between vessel 32 and vessel 30 save for plunger 52, and there was no communication between vessels 28 and 30, by virtue of closed valve 56 in pipe 36 and pressure behind one way valve 46 in pipe 34. In FIG. 3, there is no communication between vessel 32 and 30 and open valve 54 in pipe 40, is now closed. There is also no pressure in vessel 32, because of the accommodating tube 33, to force fluid past one way valve 46 between vessel 32 and vessel 30.

Referring to FIG. 3 in particular, there is illustrated open fluid exchange between vessel 30, and that part of vessel 28 before thin separating wall 29. Towards this communication, previously closed valve 56 is open. There is now fluid communication between vessel 30 and vessel 28 in pipes 36 and 34. The communication is open between vessel 28 and 30 except for the plunger 52 in vessel 30.

Vessel 30 contains fluid 44. Fluid 44 lies from time to time in vessel 30, undergoes compression at times and decompression at times. To create this compression and decompression, an electric hydraulic ram is used labelled 58 or 59. Where it is in decompression mode, it is denoted as decompressor 58, refer FIG. 2. Where it is seen in compression mode, it is compressor 59 refer FIG. 3. As use of the invention moves from that shown in FIG. 2 to that shown in FIG. 3 compressor 59 compresses the thermal fluid 44 in vessel 30 to the corresponding pressure in vessel 28. In the case the pressure in vessel 28 fluctuates, as is common in such devices, the mean pressure is matched. Only after such pressure equalization, does valve 56 between vessel 30 and vessel 28 change from closed to open. With communication open between vessel 30 and 28, motor 50 is engaged in the reverse direction, to turn rotating screw rod 51 to return plunger 52 to the upper position. The movement of plunger 52 upwards in vessel 30, under pressure equalization conditions between vessel 30 and vessel 28, forces the hot fluid above the plunger 52 to move into the instance of thermal load transfer fluid 44 in vessel 28, behind thin wall 29, and close in proximity then to working fluid 27 which it is then free to influence such as by heating. At the same time as the hot fluid 44 in vessel 30, by means of plunger 52, moves into vessel 28, relatively cool fluid 44 from vessel 28 is drawn through open valve 54 to sit under plunger 52 in vessel 30, as previously noted above. In this way there is always separation between vessel 28 and vessel 32 and there are two controlled or forced fluid exchanges, which cannot occur at the same time. The separating of the movement of plunger 52 means there is no diluting or mixing of exchange fluids in vessel 30. The advent of heating of fluid 44 inside vessel 32, by heat application on vessel 32 by the normal means, passes heat to fluid 27 inside vessel 28. The heat transfer is frustrated, by the outer wall of vessel 32, by having to pass through pumping by plunger 52 inside vessel 30, and by the wall 29 inside vessel 28.

The sum of all these frustrations has minimal impact of the quality and quantity of heat able to be applied to working fluid 27 inside vessel 28. In contrast the thick wall of vessel of the prior art shown in FIG. 1 impedes application of heat in that instance to a far greater degree.

As shown only in FIG. 2, for ease of illustration, control system 60, is important to control the system; it is important the system is understood to be controlled rather than an uncontrolled system using simple heat exchange. Control system 60 consists of Arduino (Trade Mark) unit 62, relay board 64, power source for switching 66 and power source to drive the controlled devices 68. These power sources are of a known form and are shown schematically, indicating their inclusion to provide the necessary power, as would be readily understood by a person skilled in the art. Arduino (Trade Mark) unit 62 is a single board microcontroller of a known form. Other similar arrangements could be used instead, suitable for control of the apparatus.

Connected to the Arduino (Trade Mark) unit 62 are 4 inputs, one from pressure sensor 48*a* inside vessel 28, one from temperature sensor 49*a* inside vessel 28 in the instance of fluid 44, one for pressure sensor 48*b* inside vessel 30, and one for temperature sensor 49*b* in vessel 32, under fluid 44.

The connections to relay board 64 are indicated diagrammatically in FIG. 2, for ease of illustration, as would be readily understood by a person skilled in the art. These connections are noted as connection 69 to pressure sensor 48*a*, connection 70 to temperature sensor 49*a*, connection 71 to the pressure sensor 48*b* in vessel 30, and connection 72 to temperature sensor 49*b*. These 4 connections 69, 70, 71, and 72, are between the listed sensors and Arduino (Trade Mark) unit 62. The remaining 8 connections are to relay board 64, and indirectly to the Arduino (Trade Mark) unit 62. These are connection 73, to open the valve between vessels 28 and 30. Connection 74 to close valve 56 between vessels 28 and 30. Connection 75, to enable compression of the fluid in vessel 30 by electric hydraulic ram 59. Connection 76, to enable decompression of the fluid in vessel 30 by electric hydraulic ram labelled alternately 58. Connection 77 opens valve 54 between vessel 30 and vessel 32. Connection 78 closes valve 54 between vessel 30 and vessel 32. Note that in some cases the same devices are labelled alternately depending on their state. Connection 79 enables the lowering of the plunger 52 by motor 50. Connection 80 enables the raising of the plunger 52 by the motor 50.

Control, and separation of the pressures, is maintained by the following method of use of the invention, in strict order. Note in the case the input from connection 72 from temperature sensor 49*a* is reading above 200 degrees Celsius and the difference between the readings from connection 70 of temperature sensor 49*a* in vessel 28, and connection 72 of temperature sensor 49*b* in vessel 30 is equal to or above 30 degrees Celsius, start the cycle, otherwise wait two minutes, for example where the heat applied to vessel 32 is not enough to warrant the effort The microcontroller Arduino (Trade Mark) unit reads the sensor output for the control system. These readings may be visible on an associated computer monitoring system. Steps of method for 1 hour Cycle:

1. Power connection 79 for 10 seconds, to move plunger 52 down (pump);
2. Power connection 78 for 5 seconds, close valve 54 in pipe 40 between vessels 30 and 32;
3. Power connection 75, until the reading on Arduino (Trade Mark) unit 62 from connection 69 of pressure sensor 48*a* in vessel 28 and connection 71 of 48*b* in vessel 30, match, compress;
4. Power connection 73 for closed valve 56 for 5 seconds, to open between vessels 28 and 30;
5. Power connection 80 for 10 seconds, to raise plunger 52 up(pump);
6. Power connection 74 for 5 seconds, to close value 56 between vessels 28 and 30;
7. Power connection 76, until the reading from sensor 71 pressure sensor 48*b* in vessel 30=zero pressure, decompress;
8. Power connection 77 for 5 seconds, open valve 54 between vessels 28 and 30; and
9. Go to start.

Figure 5:
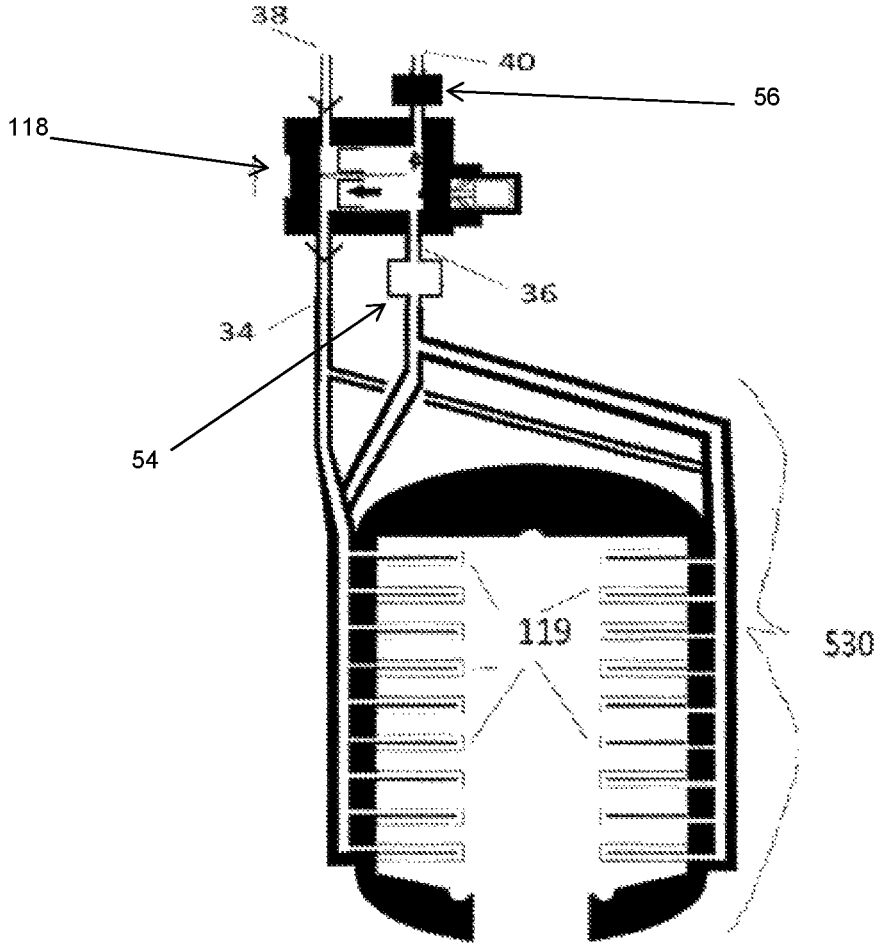
FIG. 5 is schematic front view of the embodiment of FIG. 7 showing the heating vessels.
Figure 6:
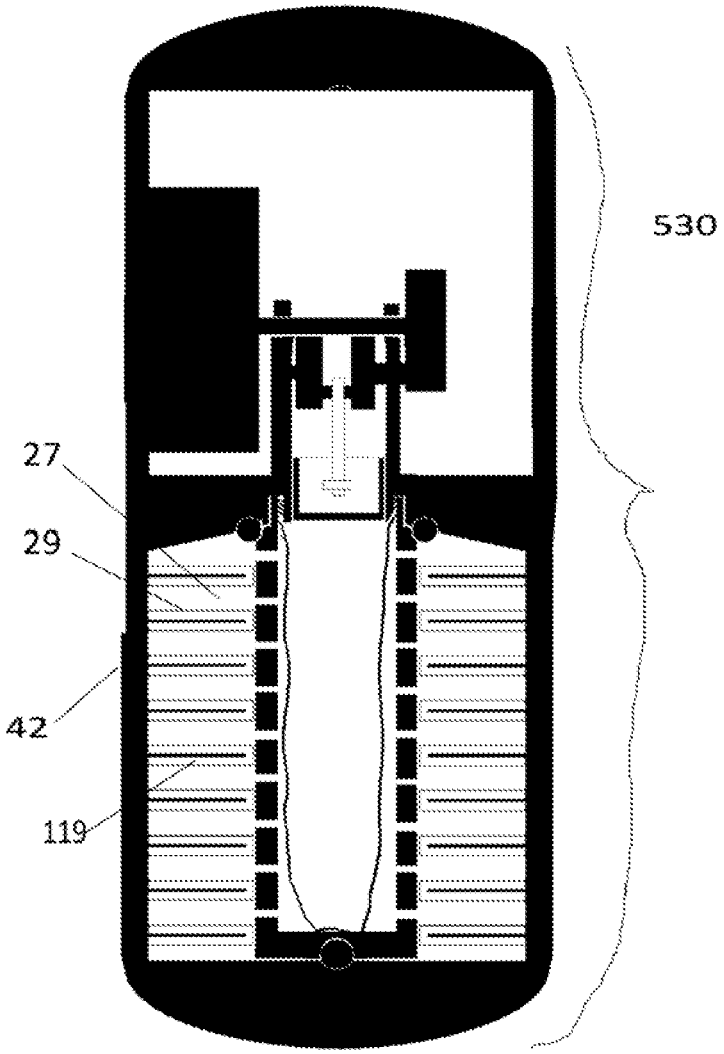
FIG. 6 is schematic front view of the embodiment of FIG. 5 showing the heating vessels.

After the hour, due to different densities between hot and cold fluid 44, the compression and decompression of fluid 44 by compressor/decompressor 58/59, results in a very slight net result of fluid 44 moving, from vessel 28 to vessel 32, over a long period of operation. A reversal mechanism for that is found in that the Arduino (Trade Mark) unit checks the mean pressure in vessel 28 every hour, and over decompresses in the decompression cycle in the case where needed. This draws a slight amount of extra fluid from vessel 32, through at least the one-way valve 46 in pipe 38, then it over-compresses wherein the extra fluid 44 passes to vessel 28 by means of vessel 34. This is followed by decompression. Cycle is repeated until the pressure as measured by pressure sensor 48*a* has been returned to optimum/normal, indication the correct apportionment of fluid 44 in the system, protecting wall 29 from excessive flex. In the case the sensors detect the reverse situation, the reverse remedy is instigated. After the hour checks on the system the process may be repeated for a further hour, and so on Referring to FIGS. 4 to 7, a second preferred embodiment of the invention will be described, in highly stylised schematics for ease of illustration. The reference numerals used have been chosen to use same numerals as the first preferred embodiment to indicate similar or equivalent parts, but are clearly different parts embodiment 1 to embodiment 2. Pressure capable vessel 118 is in fluid communication with a hot water inlet 38, a cold water outlet 40, and 18 heating vessels 119 (refer FIG. 5), inside the pressure vessel of device 530.

The purpose of the use of the invention in the second embodiment is to provide a means for the hot water to enter the device 530, inside the heating elements to influence working fluid inside of device 530, and to remove water cooled in the above process. Prior art apparatus would require the thermal energy in the hot water to pass through thick walls 42, which would not work well. In by-passing the thick walls, the invention, in the second embodiment, allows the hot water to be separated from the working fluid by the thin walls of the heating elements, whose contents are at the same pressure as the working fluid.

The 18 heating vessels 119 are plumbed so that in essence then, vessel 118 is in fluid communication with source of heat, pipe 38, means to supply heat to the heating elements, pipe 34, means for retrieving cooler water, pipe 36, and means to dispose of that cooler water, pipe 40. Open fluid communication exists between pipe 34 and pipe 36, so heating fluid which may enter pipe 34 can move into the heating fingers, do the heating, and leave the cooling fingers via pipe 36. This fluid communication remains open.

The fluid communication between vessel 118 and pipe 40 is controlled by a valve 56. The fluid communication between vessel 118 and pipe 36 is controlled by valve 54. The fluid communication between vessel 118 and pipe 38 is controlled by directional valve towards vessel 118, and sometimes by pressure inside vessel 118. The fluid communication between vessel 118 and pipe 34 is controlled by directional valve towards pipe 34, and sometimes by the pressure behind pipe 34, which is the same pressure as the working fluid inside device 530, noted at 200 bar.

So the fluid communication is very controlled. A 200 Bar plus pressure inside vessel 118 would open communication to pipe 34. A vacuum inside vessel 118 would open communication from pipe 38. All communications are controlled by some means except that between pipe 36 and pipe 34, which together with the volumes inside the heating elements 119 inside the device 530, can be considered one volume or vessel, wherein the volume of vessel 118, when in open communication with both pipe 34 and 36, forms a circuit, which can lead to exchange of fluid.

In all the workings of the invention, separation is important, because uncontrolled communication might lead to the 200 bar pressure inside pipe 34 and pipe 36 to reach the low pressure pipes 38 and 40, causing major failure.

In this form of the invention, the apparatus can bring the hot water of pipe 38 into the pressure regime of vessel 530 without loss of temperature, a significant benefit to industry, and makes recovery of energy from low temperature heat a reality.

Figure 7:
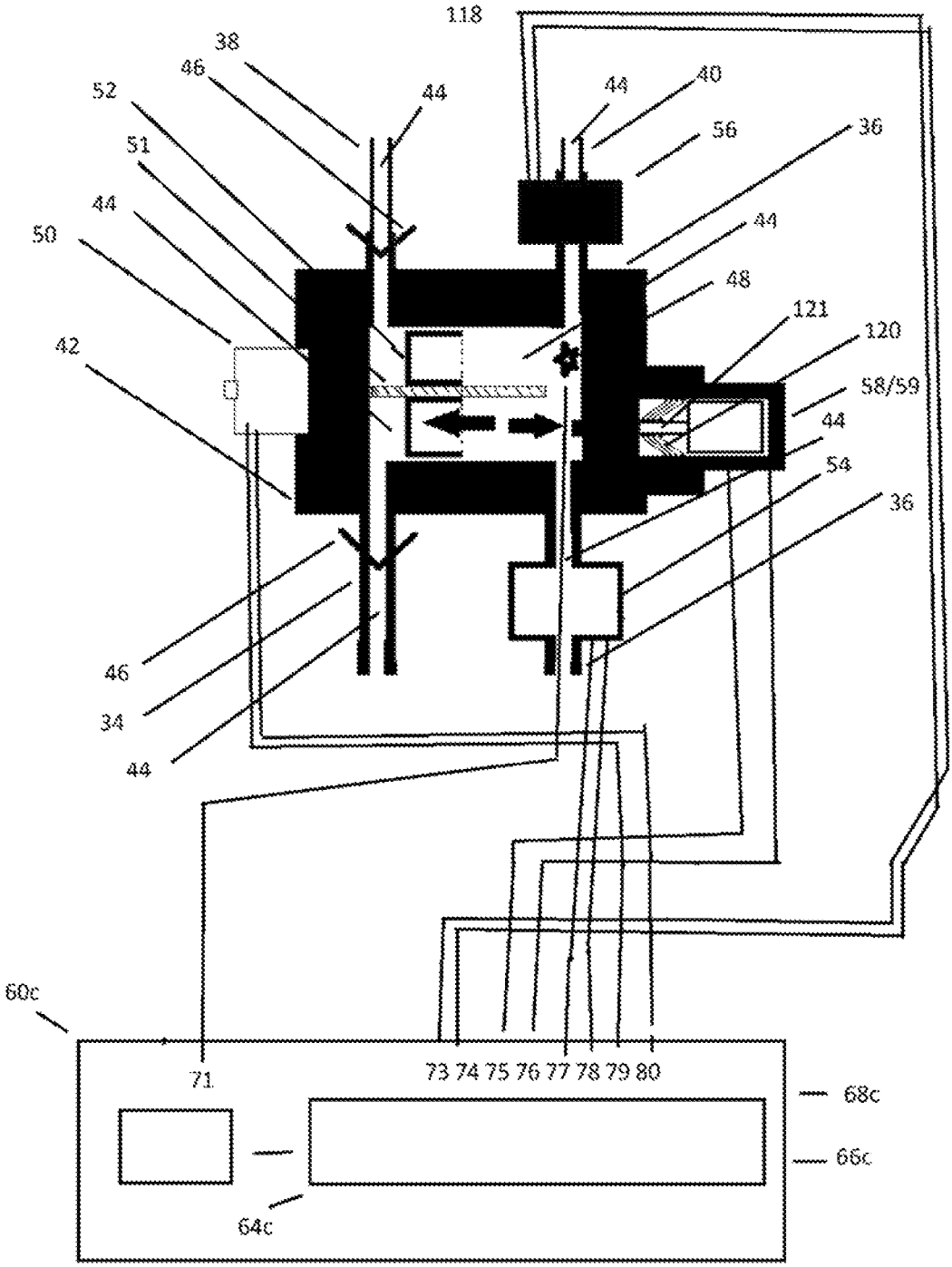
FIG. 7 is a schematic front view of the embodiment of FIGS. 4 to 6 showing the control system.

Referring in particular to FIG. 7 control mechanism 60 is illustrated, consisting of Arduino (Trade Mark) micro controller 62, and relay board 64, and connections to both valves 56 and 54, as well as connection to decompression/recompression device 58/59 and motor 50 as would be normal in control of these devices. Pressure sensor **48*b* is an input. In the normal manner of control, communication is opened between vessel 118 and pipe 40 by opening valve 56. This with the directional valve in pipe 38**, would allow a one way communication.

Motor 50, by drive rod 51, moves plunger 52 from left to right, instigating a swapping of fluid from pipe 38 to vessel 118, and from vessel 118 to pipe 40. Note that no fluid passes directly, nor indirectly with its current thermal load, from vessel 38 to vessel 40. Instead, cool fluid in vessel 118 was ejected via waste pipe 40, and hot fluid, water in this embodiment, is drawn into the volume of 118. One exchange has afforded another exchange at the same pressure.

Now the control mechanism closes off valve 56, closing the communication between vessel 118 and pipe 40. Now by means of the control, the pressure of vessel 118, and indeed the pressure of the new hot water, is increased to 200 bar by the electric hydraulic ram 58/59. In this embodiment, a release of tension in the devices 120 aids the compression of the water in vessel 118 to 200 bar, measured by control input from 48b.

After this compression, both pipes 38 and 40 have been dis-communicated, pipe 40 as disclosed above, and pipe 38 by means of pressure against a directional valve.

Control 60, now opens valve 54. There is no pressure variable each side of valve 54, and it requires a rotation in the reverse direction by motor 50 to move plunger 52 from right to left.

Plunger 52 forces the new hot water it previously acquired from pipe 38, down pipe 34 to service the heating vessels 119 in device 530, while at the same time drawing spent water, relatively cold, from pipe 36 to fill the vessel 118.

The process has come full circle, when the valve 54 is closed, and the internal pressure of the vessel 118 is released.

That pressure is released by the withdrawing of the rod 121 from left to right, making the internal volume of vessel 118 slightly greater. A good portion of the energy released in decompressing volume 118 from 200 Bar to ambient, is absorbed by the spring devices 120, which compress to absorb some of the energy. Spring devices 120 have one end attached to the rod being withdrawn, and the other attached to the vessel wall of the device 58/59.

In compressing the spring material and in that absorbing of energy, the ends on the devices 120 get closer. It is an outcome of this form of the invention, that less energy is absorbed by devices 120 as the rod 121 moves to the right, and there is less decompression energy to absorb. This is an ideal energy saver, which relinquishes the saved energy during a later compression cycle of vessel 113 in an ideal way.

This embodiment has an energy saving mechanism for the decompression/recompression. The energy saving device shown is stylised and indicative of many energy saving devices that could recuperated some of the energy involved.

This is important to the invention in terms of the use of low grade heat, for example in the case where the heat differential were only 30 degrees Celsius, and the pressure used 400 bar, the cost of the compression might exceed the thermal energy contained in 30 degrees Celsius for any given volume of water.

The hot water used in the above equipment must be below boiling temperature. In the case water above boiling point needs to be put through such a device, a heat exchanger must be installed at pipe 38 and a boil proof $2^{nd}$ fluid put through this device, in that case the outflow 40 is returned to the heat exchanger to accept more heat from the source.

Clearly, use of the apparatus of the prior art would not allow the use of a 200 Bar device for perhaps a 60 Degree Celsius temperature differential. Such low-grade heat is unable to pass through 30 millimetre steel walls in any meaningful way.

The second embodiment provides a valid method for the extraction of power from low grade heat, be that heat from geothermal source of 90 degree Celsius, or from a sleeve around a car exhaust at 300 Celsius. In the latter, the heating and cooling fluid water, in this embodiment, is replaced with a fluid of greater boiling point, like brake-fluid.

Figure 8:
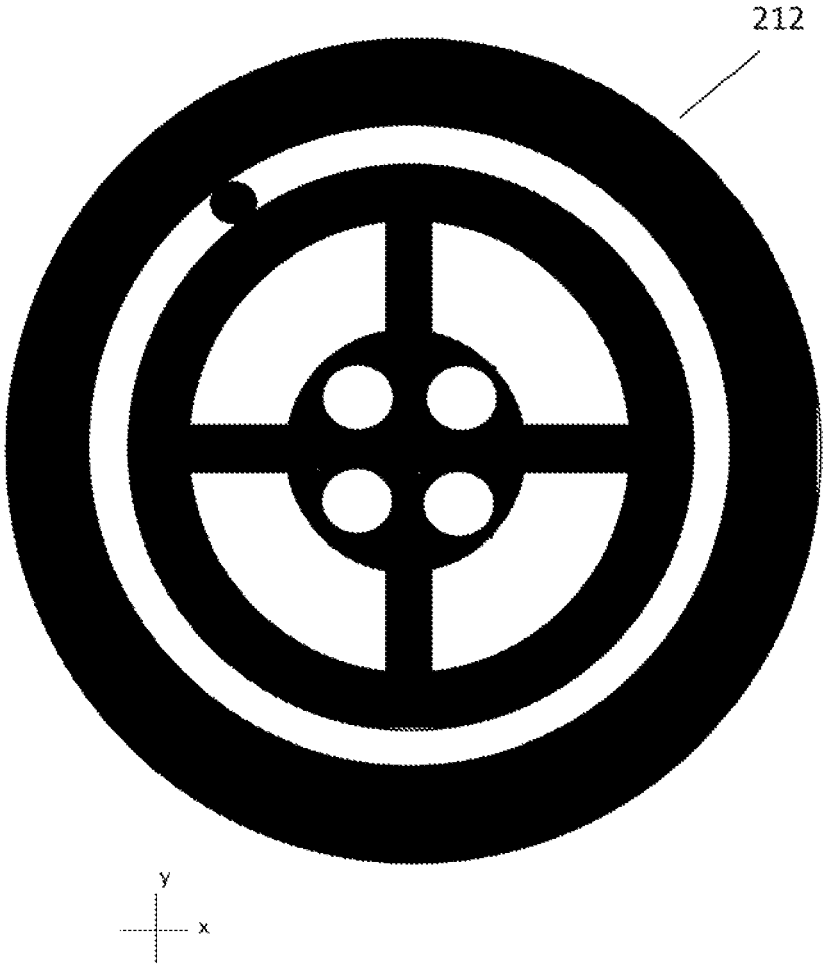
FIG. 8 is a schematic view from above of part of a third preferred embodiment of the invention.
Figure 9:
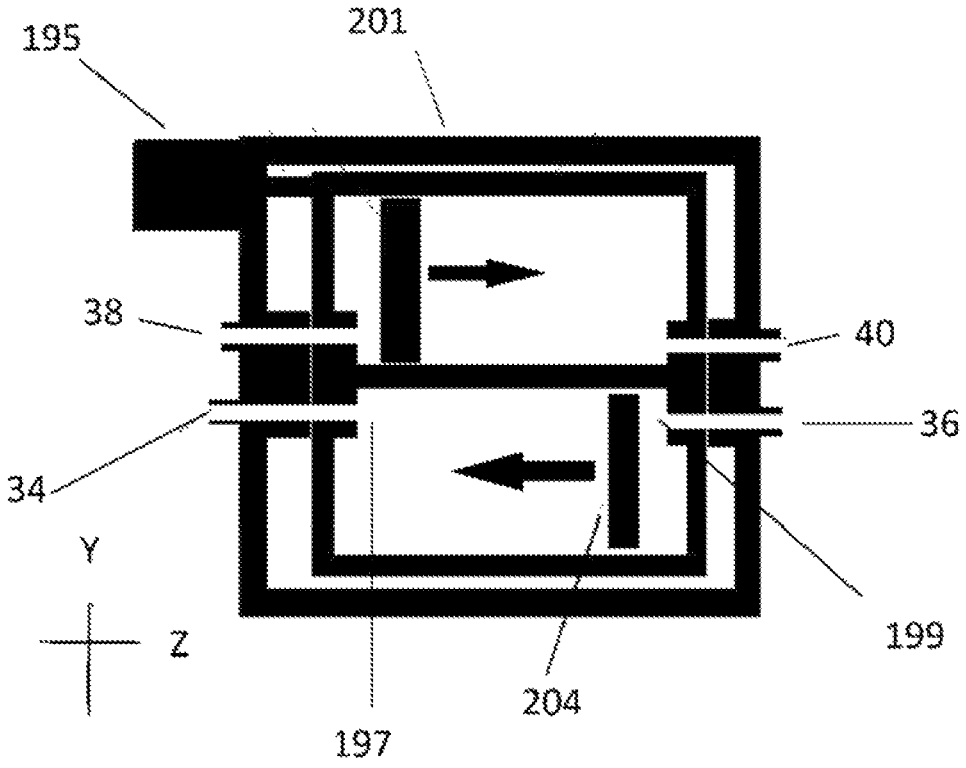
FIG. 9 is a schematic front view of another part of the third preferred embodiment of the invention corresponding to FIG. 8.
Figure 10:
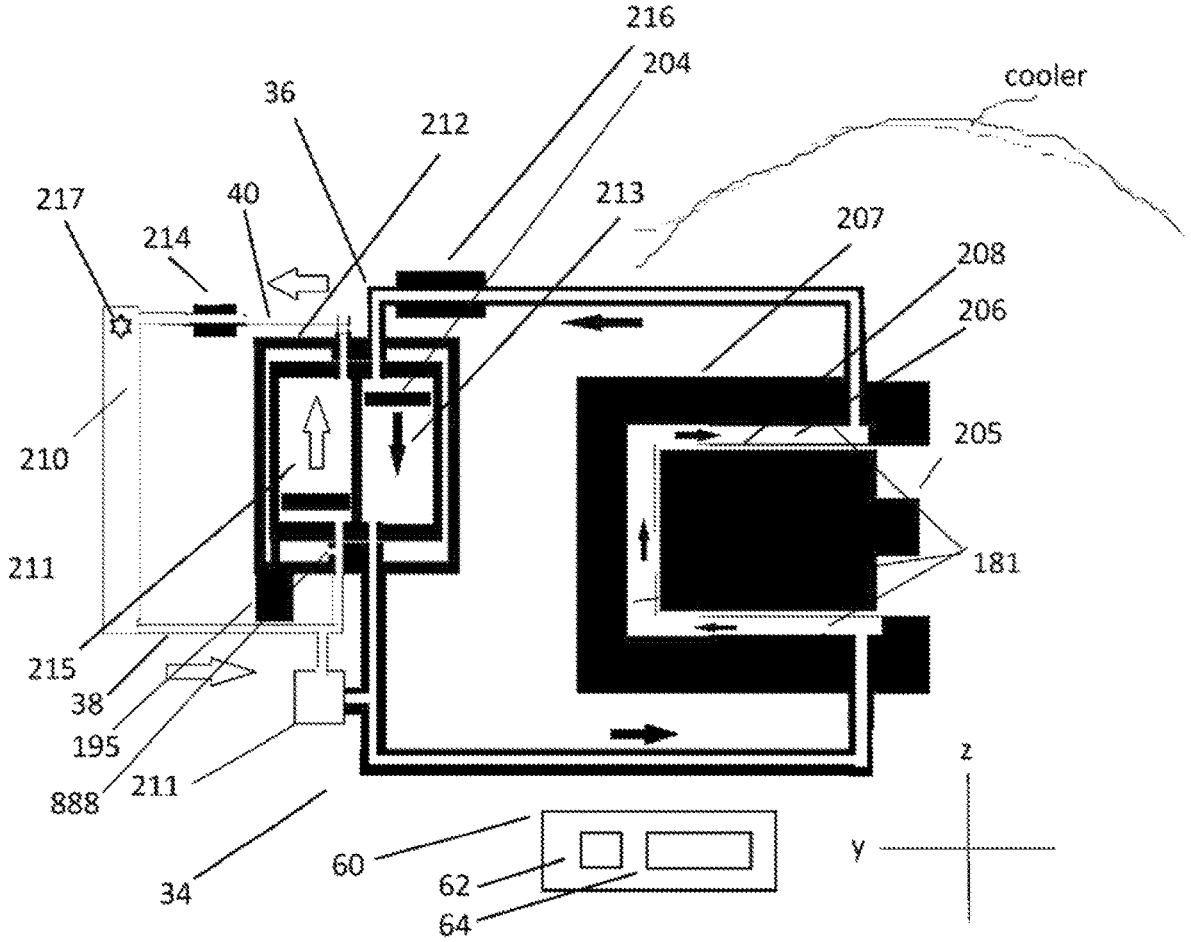
FIG. 10 is a schematic front view of the third preferred embodiment of the invention corresponding to FIGS. 8 and 9.

Referring to FIGS. 8 to 10, a third preferred embodiment of the invention will be described in a highly stylised schematic for ease of illustration.

Referring in particular to FIG. 10, a reverse cycle Stirling device acting as a cooling device, not dissimilar to a cryogenic cooler, is represented in part by cooling head 207, and displacer 205, showing the heating cycle with the displacer having moved the working fluid 27 substantially away from cool head 207.

There is an instance of a fluid 206 which finds itself in a sleeve 181, formed between thin wall 208 and cooling head 207. Sleeve 181, containing fluid 206, collects the substantial portion of the cool effect made by the device of the cooler.

The fluid 206, a thermal fluid DYNALENE MV (Trade Mark), by way of example only, not unlike some of the Duratherm (Trade Mark) range of fluids, resides in the sleeve 181, as well as in all pipes shown, and well as in vessels 213, 215 and 210, and in fact through the entire system. In every vessel except where working fluid 27 is shown.

There is interrupted fluid communication between the instance of fluid 206 residing inside the cooling head 207, and the fluid 206 residing in the thin walled vessel 210. There is a separation between these 2 instances of the fluid. There is never open fluid communication between these two vessels.

Typically, the cooler represented by the cooling head 207, has its working fluid 27 operating in a cyclic manner in that the pressure of the working fluid 27 is alternated between being at low pressure and being at high pressure. The maximum high pressure is limited in the prior art because of the need, in the prior art, for the cool effect to pass through the thick walls of cooling head 207.

In this embodiment, the cooling is taken up by the instance of the fluid 206 in sleeve 181, and there is no need for any cool affect to pass through the thick walls of the cooling head 207. In this instance the thick walls are 60 mm thick, allowing the cooling device to operate with a great pressure in the heating cycle.

The coolant, thermal fluid 206, is moved to the thin walled vessel 210.

Here in the vessel 210, the cooling effect can be passed on for various uses through the thin walls of vessel 210 for use in industries including food processing, pharmaceutical, chemical, cryogenic and other refrigeration industries, as examples.

There is controlled and interrupted fluid communication to move cool thermal fluid out of cooling head 207 and to return warmer fluid. This fluid communication is at high pressure, necessitated by the pressure of the working fluid 27 reaching great pressure. The walls 208 withstand that pressure because fluid 206 in virtually incompressible. All vessels in this fluid communication are deemed to be able to withstand pressures upwards of 1000 Bar. The high pressure in this cycle is represented by the darker arrows in FIG. 10.

There is also controlled and interrupted fluid communication to remove warmer thermal fluid from vessel 210 and draw in cooler fluid. This fluid communication is at a substantially lower pressure. In this example it is ambient pressure and represented by the lighter arrows.

The device of this embodiment of the invention takes a segment of the high-pressure fluid communication, represented, by vessel 213, isolates it and swaps it out to the low pressure system, similarly, vessel 215, and essentially its contents, is isolated, and moved to form part of the high pressure communication. In thus doing, relatively warm thermal fluid is moved from the communication cycle depicted on the left, to the high-pressure communication cycle on the right, whereupon it is moved via pipe 34 into the cooling head 207 to lose heat.

In a similar manner, thermal fluid cooled by cooling head 207, is moved from the high-pressure communication environment, to the low-pressure communication environment, wherein it can enter vessel 210 and remove heat through the thin walls of vessel 210 in the usual manner.

FIG. 10 shows fluid 206 leaving the cool head 207 through pipe 36, entering the cool head 207 through pipe 34. Furthermore FIG. 10 shows cooling fluid 206 entering the thin walled vessel 210 through pipe 40, and leaving vessel 210 through vessel 38. Pump 216, in part, controls the flow of thermal fluid in the high pressure system, and pump 214 does, in part, control the flow of the fluid 206 in the low pressure system.

Control mechanism 60, by virtue of micro controller 62 and relay board 64, and other items normal in such control mechanisms, has operational control over pump 216, pump 214, drive motor 195, and electric hydraulic pump 211.

A sensor 217 measures the pressure of the fluid 206 inside vessel 210. Control 60 regulates the pressure inside of vessel 210, by means of sensor 217, and using the electric hydraulic pump 211. In doing this, it compensates for any net gain or loss of fluid 206 between the high pressure and low pressure systems. In this embodiment, there is no decompression of the vessel 213, before the vessel and its contents are swapped, from their current position in FIG. 10, to the position of vessel 215, in FIG. 10. In this case, the slight compressibility of fluids, and that fluids of different temperatures occupy the same space but with different mass, both these issues, as they apply to this embodiment, are dealt with on a system basis, rather than a "per exchange of communication segment" basis. This simplifies the swapping mechanism, potentially allowing for a faster, and more continuous movement of fluid 206.

The control mechanism 60 performs the following operations. In the case the pressure according to sensor 217 is incorrect, electric hydraulic pump 211 corrects the discrepancy. In the case the pressure is correct, Pumps 216 and 214 pump, and motor 195 rotates a set of 4 vessels, about the z axis. From time to time, when an input from sensor 217 requires it, the control mechanism again rectifies the matter of net mass transfer via electric hydraulic pump 211. In an ongoing operation, the above is the limit of a minimalistic control of the invention. The cooling device, whose cooling head is 207 has its own control and further parts not shown here.

FIGS. 8 and 9, together, depict a revolving set of 4 vessels, where each of the vessels has 2 ports, 197 and 199, positioned so that in one range of positions around the rotation, about the z axis, they align with flanges of both pipes 34 and 36, and in another range of positions around the rotation, they align with the flanges of pipes 38 and 40.

When they align with pipes 34 and 36, the pressure from pump 216 forces recently cooled fluid 206 into the vessel and the instance of fluid 206 the other side of separator 204, is expelled to return to the sleeve inside cooling head 207 via pipe 34.

When the ports in any of the 4 vessels line up with the flanges of the pipes 38 and 40, and under the pressure of pump 214, separator 204 is forced to move to accommodate an influx of fluid 206 from pipe 38, and the fluid that was in the vessel from the previous cycle, is expelled via pipe 40 to vessel 210. A rotation of the 4 vessels, results in fluid from the high-pressure cycle, being diverted to the low-pressure cycle, and fluid from the low pressure cycle being diverted to the high pressure circle. In doing this, the device of the invention is switching thermal load, by switching volumes, by means of switching vessels, between pressure regimes. The fact that all instances of fluid 206 are liquid at the time of switching are critical in that fluids are virtually incompressible, and the PV of the lost fluid is substantially the same as the PV of the gained fluid, making the compensating work done by pump 211, manageable. Except for vessel 210, and pipes 38 and 40, and pump 214, except for these, all the rest of the device, except wall 208, consist of thicknesses and materials to handle, in this case 1000 bar plus. The rotation of the 4 vessels to line up with the flanges of the pipes, in not dissimilar to a rotary valve. Separator 204 could be changed to a separating diaphragm. Leaks in the "rotary valving" if any, find their way to the low pressure system by port 888, where electric hydraulic pump 211 would compensate in the normal manner prescribed herein in the normal course of its' operation.

Referring to FIGS. 11 to 15 a fourth preferred embodiment of the invention will be described, a switching mechanism for a thermal load, in a highly-stylised schematic for ease of illustration. As illustrated four vessels, 442, 450, 500 and 454 are in controlled and segmented fluid communication, for the purposes of pumping water.

A heat source of hot brake-fluid 441, by action of pump 448, enters heat exchanger 442, by pipe 444, and leaves by pipe 443. This is done under great pressure of 500 bar so that the water at 446 through heat exchanger surface 449 acquires supercritical status, without boiling. Vessel 442 is a pressure vessel, as is vessel 450, as is vessel 454.

Control means 475 is the control means to start and stop the pumps shown, open and shut the valves, and operate the pumps in a required sequence, and some instances for set durations, in the normal manner of microcontrollers, linked to relay boards and like in control devices as is usual.

Figure 11:
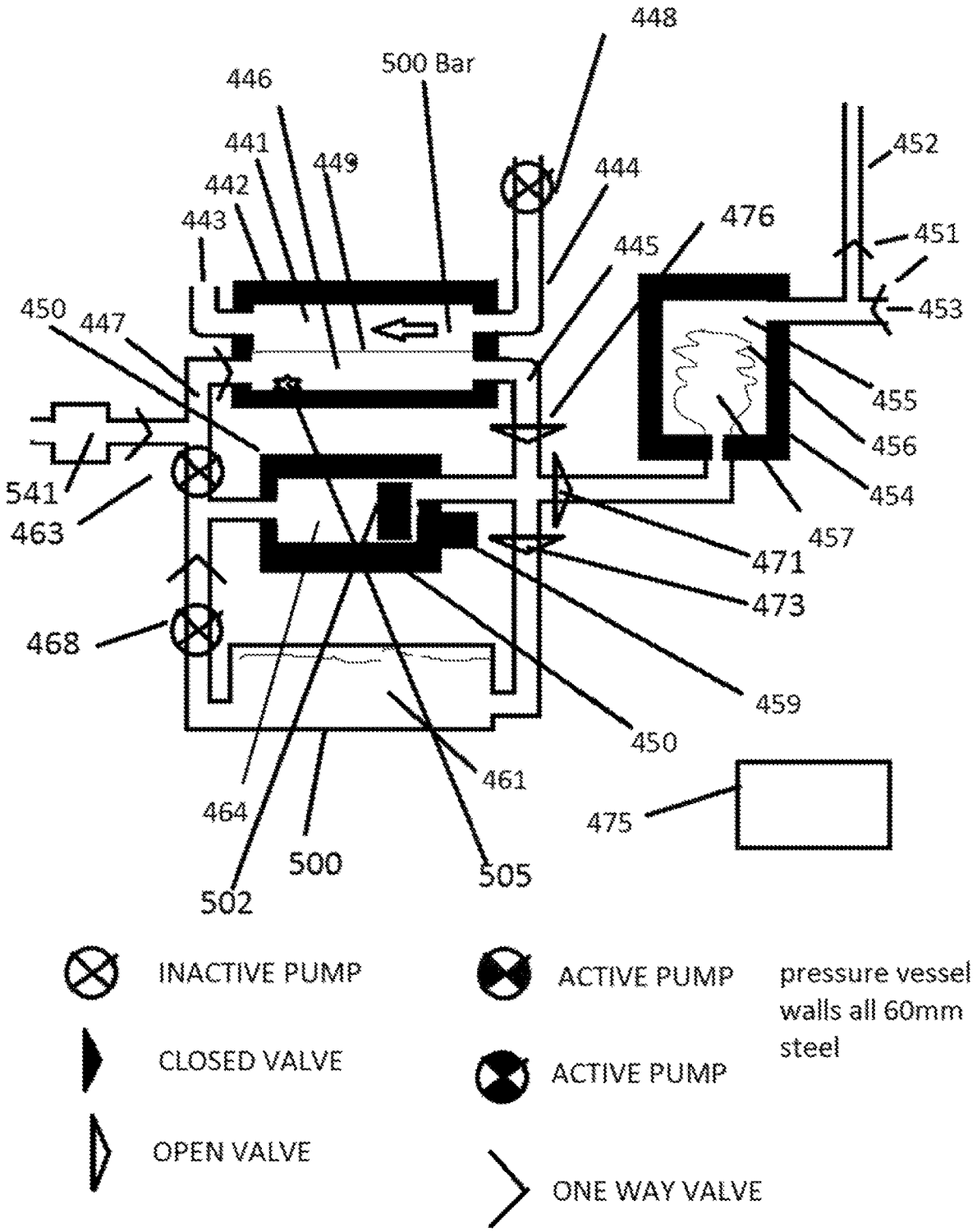
FIG. 11 is a schematic front view of a fourth preferred embodiment of the invention.
Figure 12:
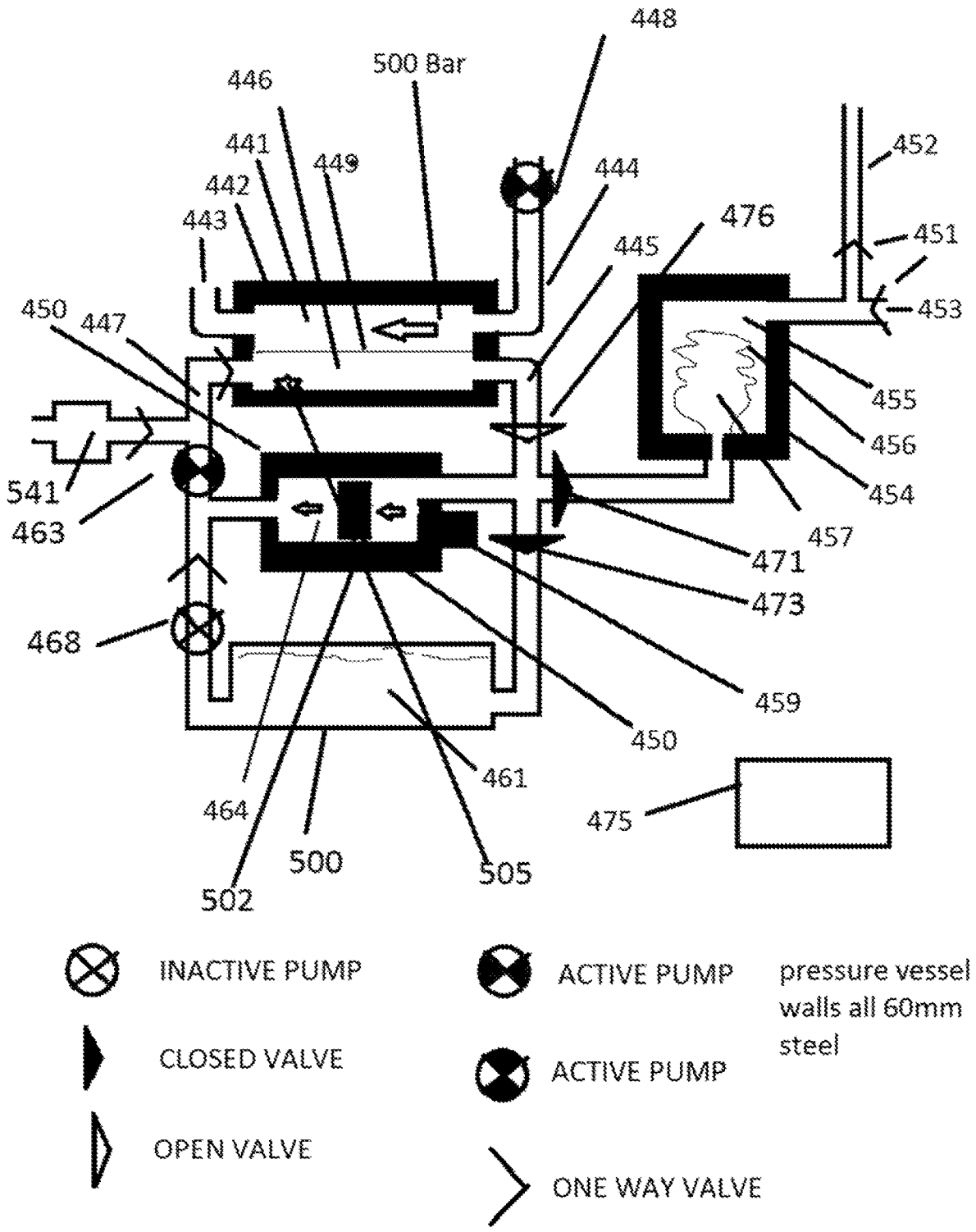
FIG. 12 is a schematic front view of the embodiment of FIG. 11.

Referring to FIG. 12, we see a fluid communication in that pump 462 is shown as active, bringing in 500 Degrees Celsius brake-fluid 441, to act on water 446, which turns supercritical in the normal reaction to being exposed to that heat through thin membrane 449 (refer FIG. 11). Water feed pump 541, with inbuilt pressure sensing ability, maintains 500 bar pressure on water 446, to match the pressure of the brake-fluid 441. This only occurs in part of the cycle, each cycle. Therefore, at 500 bar, the water in this boiler 442, never boils, and is controlled.

Referring to FIG. 12 we see a fluid communication between the water component inside vessel 442, namely 446, and the instance of water in vessel 450, named 464. This fluid communication is aided by an open valve in pipe 445, and determined in part by the closing of the valves at 471 and 473. Pump 463 is active, and that has resulted in cool water, previously drawn from condenser 500, and sited to the left of plug 502, having being moved from vessel 450 to vessel 442. At the same time, supercritical water from vessel 442, has been moved, again by the same pumping action of pump 463, to the right of the plug 502, these two events have in effect, moved the plug 502, from right to left. There is no net loss of water from vessel 442, in this exchange, and although supercritical water was removed, there was no need to engage the water feed pump to replace the volume. Fair fluid exchange under the means of this invention, has been achieved without substantial loss of water. In boilers operating under prior art, water feed requirements to replace steam leaving a system in the normal manner might cost efficiency of a power station or boiler 2 to 5%. The device of this invention, in this instance has saved that efficiency.

Figure 13:
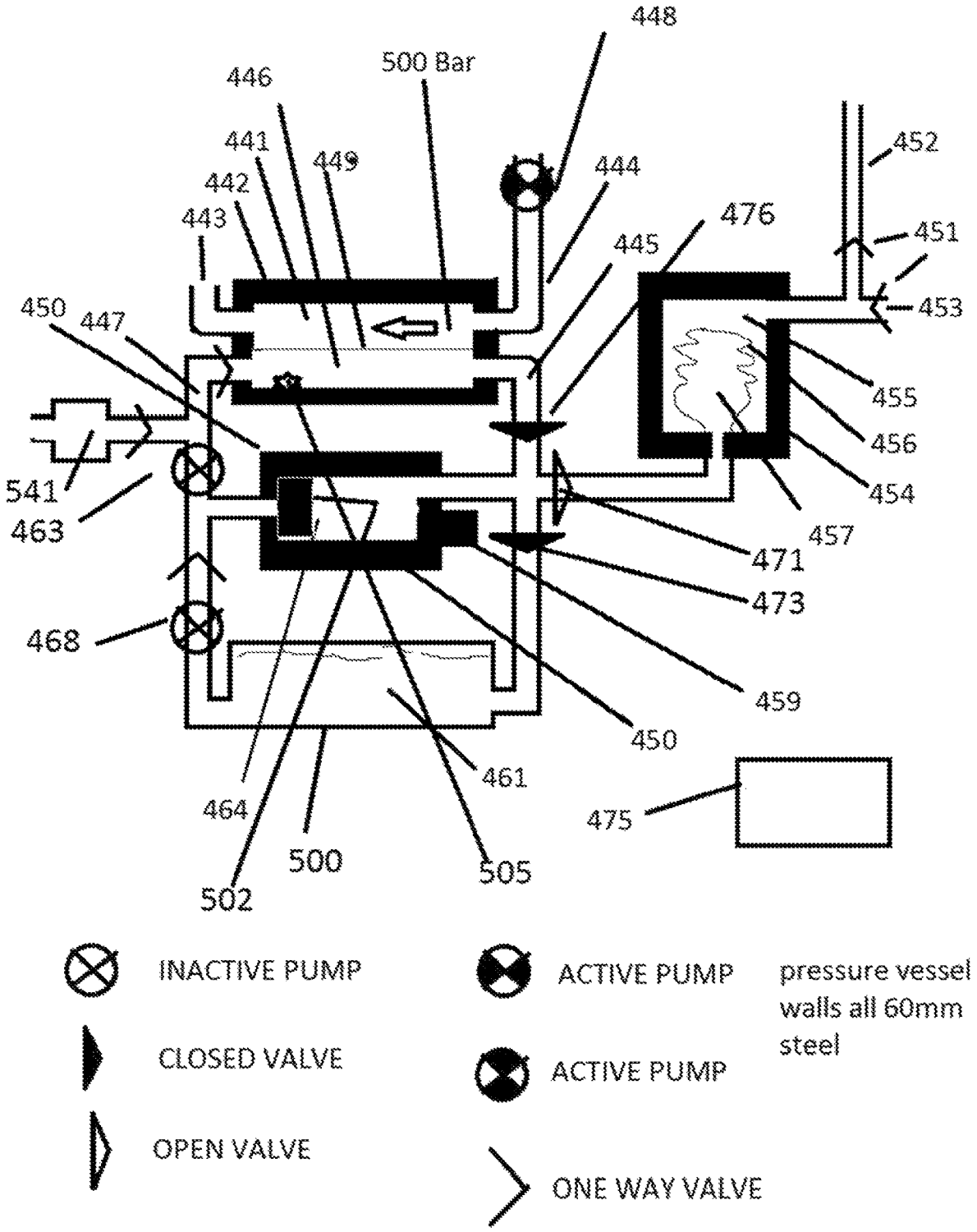
FIG. 13 is a schematic front view of the embodiment of FIGS. 11 and 12.
Figure 14:
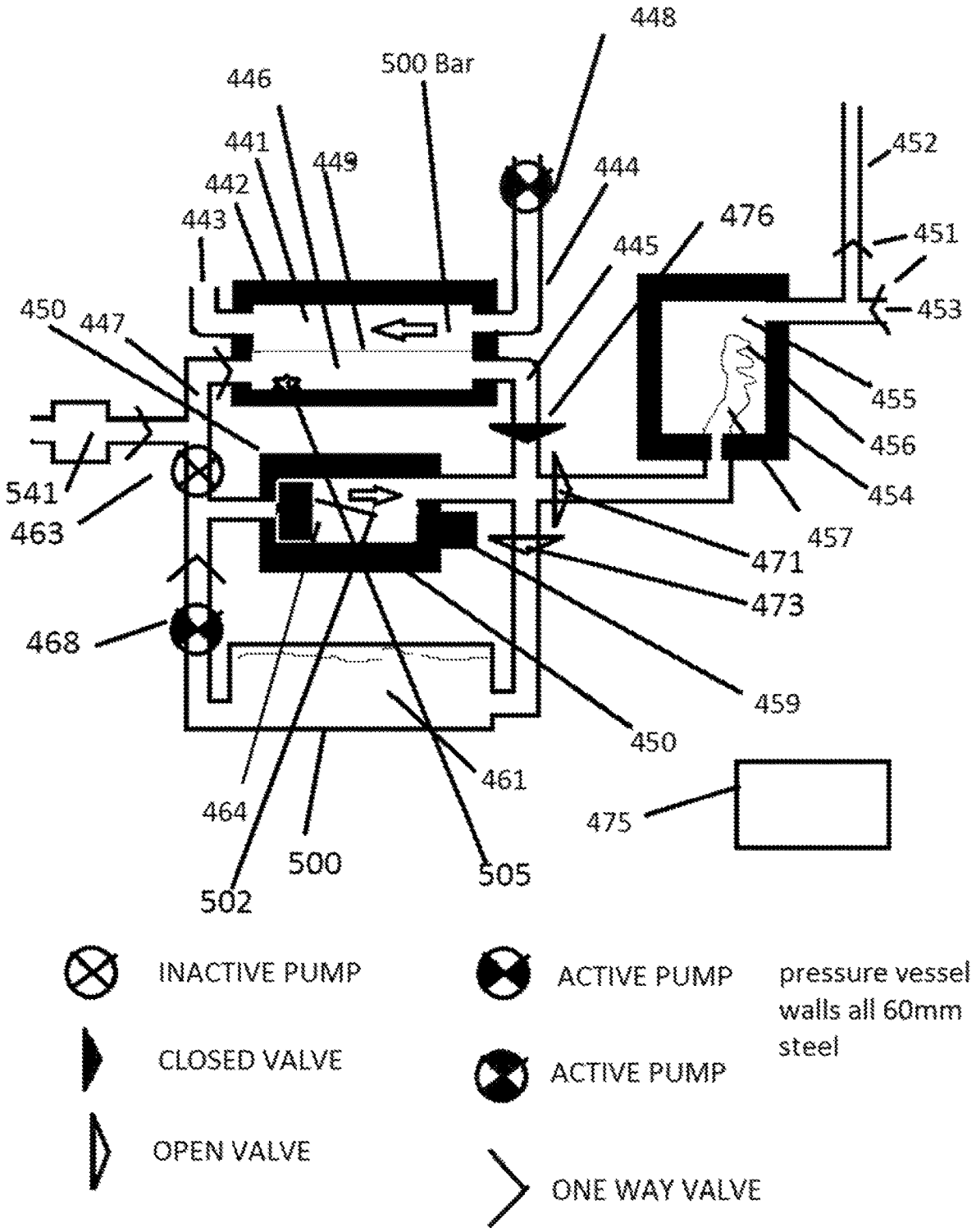
FIG. 14 is a schematic front view of the embodiment of FIGS. 11 to 13.

Referring to FIG. 13, wherein we depict that a valve was closed at 476, one opened at 471, wherein the supercritical water inside vessel 450 has turned at least in part to steam, and has expanded bladder 456 to pump water 455 past one way valve (directional valve) 451, to a greater head as normal in the requirements of farmers, etc. In FIG. 14, we see the bladder 456 deflated, which causes water sourced from 453 to enter vessel 454 to be pumped next.

The main cause for the deflation of the bladder is that an extra valve has been opened, valve 473, wherein the condenser 500 has cooled the steam and any residual water and drained vessel 450 of any remaining hot influence. This has been aided by pump 468 which is shown as active. That active pump charges vessel 450 with cold water (condensate), and in effect moves plug 502 to its former position, to the right.

Figure 15:
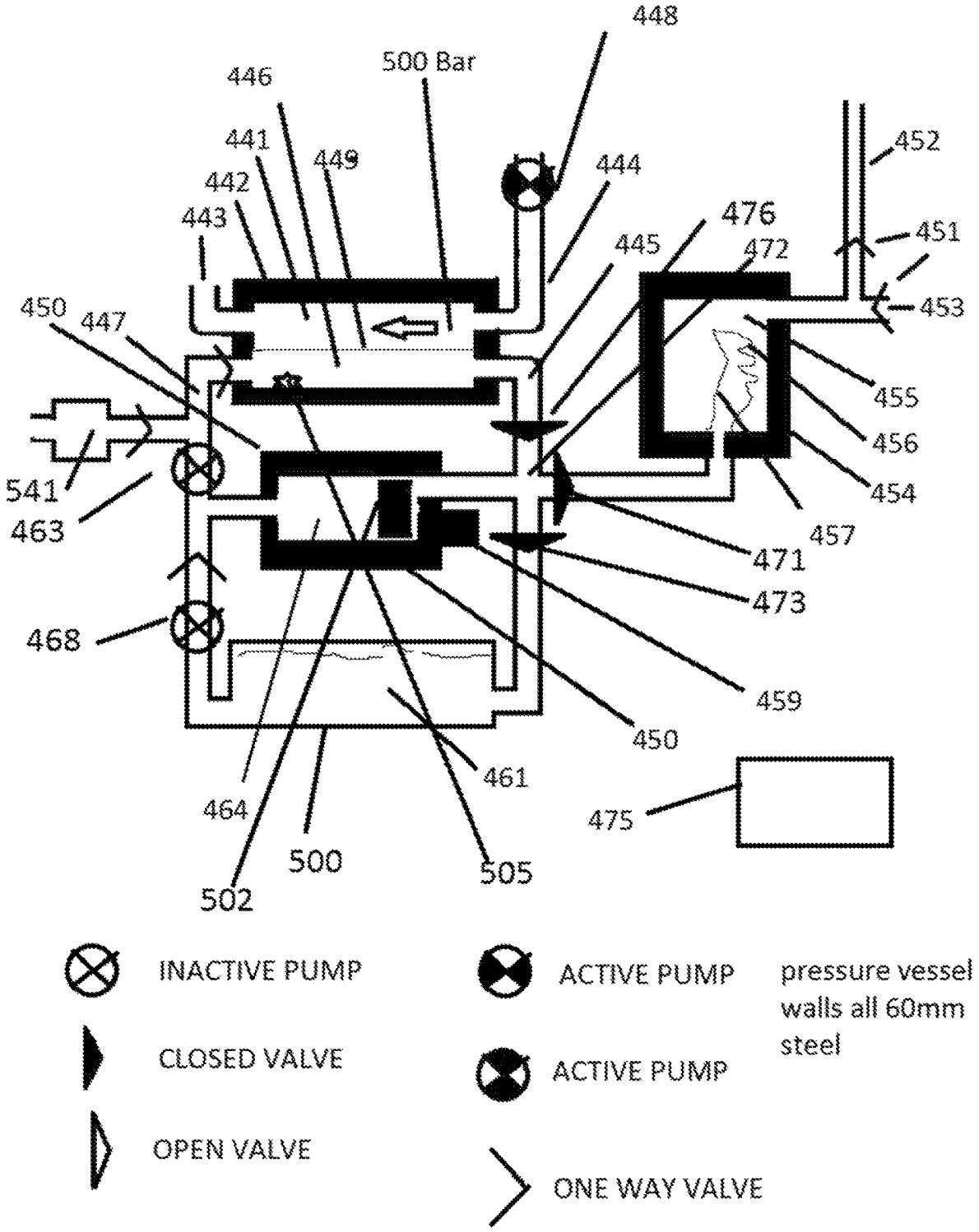
FIG. 15 is a schematic front view of the embodiment of FIGS. 11 to 14.

Referring to FIG. 15 depicts, closure of all valves wherein water feed pump 541 is activated, both to ensure no boiling in area 472, plug 502 is not a tight fit. So pressure is checked in the system, boiling is controlled, and the cycle begins again, All vessels and pipes are robust to withstand the pressures involved. Timing of the sequence and the steps is important.

The exact sequence of orders required from the control device 475 is as follows.

1. Check temperature sensor 505 for required temperature.
2. Run water feed pump 541 to check and add water if required.
3. Open valve 476
4. Operate pump 463 for 20 seconds.
5. Stop pump 463
6. Close valve 476
7. Open valve 471
8. Wait 2 minutes.
9. Open valve 473
10. Wait 20 seconds
11. Run pump 468 for 30 seconds.
12. Stop pump 468
13. Close valve 471
14. Wait 1 minute.
15. Close valve 473
16. Activate pump 541 to activate its pressure sensing equipment for 10 seconds.
17. Deactivate pump 541
18. Go to start.

It is noted that a further device under this invention can supply the brake fluid at the pressure required.

The invention is clearly one applicable in a wide range of useful industries. For example, in the automotive industry, power generation including solar, refrigeration, boilers and even in space. It is not intended to limit the scope of the invention in any way, other than as stated in the claims.

It will be apparent to a person skilled in the art that changes may be made to the embodiment disclosed herein without departing from the spirit and scope of the invention in its various aspects.

The invention claimed is:

1. A method of fluid exchange using a separation apparatus, the separation apparatus being able to be in controlled fluid communication with an inlet and an outlet, the method including the following steps:

a. opening of the inlet enabling fluid communication between the separation apparatus and a first vessel;

b. a first fluid exchange is made through the open inlet of a first volume of fluid between the separation apparatus and the first vessel;

c. a sealing/closing of the inlet to prevent further fluid communication between the separation apparatus and the first vessel;

d. an opening of the outlet enabling fluid communication between the separation apparatus and a second vessel; and e. a second fluid exchange is made through the open outlet of a second volume of fluid between the separation apparatus and the second vessel, wherein the outgoing volume of fluid and the incoming volume of fluid in each of the first and second fluid exchanges are substantially similar and there is substantially no loss of pressure by virtue of the first and second fluid exchanges, and further wherein the following step is also included:

equalisation of pressure between fluid in the separation apparatus, and fluid in each of the first and second vessels separately before the first and second fluid exchanges.

2. The method of claim 1, wherein the method also includes the following step:

controlling the opening or closing of the inlet or outlet.

3. The method of claim 1, wherein the method also includes the following step:

opening or closing of valves.

4. The method of claim 1, wherein the method also includes the following step:

moving a plunger arrangement up or down.

5. The method of claim 1, wherein the method also includes any one or more of the following steps:

a. periodic maintenance of a pressure of the fluid in at least one of the first and second vessels by pumping b. heating or cooling of the fluid in either or both of the first and second vessels, before the first and second fluid exchanges; or c. monitoring of temperature or pressure of the fluid in either or both of the first and second vessels.

6. The method of claim 1, wherein the method is utilised to create movement energy, such as a heat motor or is used as part of a refrigeration system.

7. The method of claim 1, wherein either or both of the first and second fluid exchanges is movement of fluid of one temperature towards an area of another temperature.

8. The method of claim 1, wherein a passing of a cold influence or a hot influence associated with either or both of the first and second fluid exchanges is in effect a charging or discharging of a thermal sink or battery.

9. A method of fluid exchange using a separation apparatus, the separation apparatus being able to be in controlled fluid communication with an inlet and an outlet, wherein the separation apparatus is in thermal communication with a motor containing a working fluid, the method including the following steps:

a. opening of the inlet enabling fluid communication between the separation apparatus and a first vessel;

b. a first fluid exchange at a first temperature is made through the open inlet of a first volume of fluid between the separation apparatus and the first vessel;

c. a sealing/closing of the inlet to prevent further fluid communication between the separation apparatus and the first vessel;

d. an opening of the outlet enabling fluid communication between the separation apparatus and a second vessel; and e. a second fluid exchange at a second temperature, the second temperature being different to the first temperature, is made through the open outlet of a second volume of fluid between the separation apparatus and the second vessel, wherein the first and second fluid exchanges influence the working fluid through the transfer of heat to generate movement; and f. wherein the outgoing volume of fluid and the incoming volume of fluid in each of the first and second fluid exchanges are substantially similar and there is substantially no loss of pressure by virtue of the first and second fluid exchanges, and further wherein the following step is also included:

g. periodic maintenance of a pressure of fluid in at least one of the first and second vessels by pumping.

10. The method of claim 9, wherein the method also includes the following step:

moving a plunger arrangement up or down.

11. A separation apparatus for fluid communication with an inlet and an outlet, for fluid exchange, the separation apparatus including:

a separation chamber in controllable fluid communication with an inlet and controllable fluid communication with an outlet;

a control system for controlling an opening and closing of the inlet and outlet to enable fluid exchange between the separation chamber and first and second vessels;

wherein, the control system opens the inlet whereby fluid communication of an incoming volume of fluid may occur between the separation chamber and the first vessel and then the inlet is sealed/closed, and the control system opens the outlet whereby fluid communication of an outgoing volume of fluid may occur between the separation chamber and the second vessel, and further wherein the outgoing volume of fluid and the incoming volume of fluid in each exchange are substantially the same and there is substantially no loss of pressure by virtue of the exchange and further wherein an equalisation of pressure between fluid in the separation chamber, and fluids in each of the first and second vessels separately is made before fluid communication.

12. The separation apparatus of claim 11, wherein the fluid communication includes movement of the incoming volume of fluid into the separation chamber.

13. The separation apparatus of claim 11, wherein the separation apparatus further comprises one or both of a second inlet and a second outlet.

14. The separation apparatus of claim 11, wherein one or both of the inlet and the outlet includes one or more valves, and wherein the one or more valves are one-way valves to prevent or enable fluid communication during high pressures.

15. The separation apparatus of claim 14, wherein the one or more valves are controllable by the control system.

16. The separation apparatus of claim 11, wherein the fluid exchange is controlled movement of a fluid of one temperature towards an area of another temperature.

17. The separation apparatus of claim 11, wherein the separation chamber enables controlled and separate fluid exchange between the first and second vessels without a substantial change in pressure of fluid in the first and second vessels.

18. The separation apparatus of claim 17, wherein the separation chamber is adapted to work at high pressures.

19. The separation apparatus of claim 11, wherein the control system controls opening and closing of the inlet and outlet to enable fluid communication.

20. The separation apparatus of claim 11, wherein the separation apparatus includes a plunger arrangement and the plunger arrangement acts on fluid within the separation chamber and is configured to cause movement of the incoming volume of fluid and the outgoing volume of fluid.

21. The separation apparatus of claim 20, wherein the plunger arrangement determines a volume of the incoming volume of fluid and the outgoing volume of fluid.

22. The separation apparatus of claim 11, wherein the first vessel is a first location of fluid and the second vessel is a second location of fluid and there is a temperature difference between the first location of fluid and the second location of fluid.

23. The separation apparatus of claim 22, wherein the first location of fluid may be acted upon by heat so that fluid in the first location of fluid is hotter than other fluid in the separation apparatus.

24. The separation apparatus of claim 22, wherein the first location of fluid has a wall thinner than a threshold thickness suitable for rapid heating of fluid contained in the first location of fluid.

25. The separation apparatus of claim 22, wherein the first location of fluid is a cooling head.

26. The separation apparatus of claim 22, wherein the first location of fluid is a heating vessel.

27. The separation apparatus of claim 26, further comprising a plurality of heating vessels arranged for rapid heating of fluid prior to fluid exchange with the separation chamber.

28. The separation apparatus of claim 22, wherein the second location of fluid is adapted to withstand high pressures.

29. The separation apparatus of claim 28, wherein the second location of fluid includes a wall thicker than a threshold thickness to withstand the high pressures.

30. The separation apparatus of claim 28, wherein the high pressures are greater than 200 bar.

31. The separation apparatus of claim 22, wherein the second location of fluid is a location whereby a temperature of fluid contained within the second location of fluid can influence another fluid separated from the fluid contained within the second location of fluid by a wall.

32. The separation apparatus of claim 31, wherein the second location of fluid is at high pressure contained within a wall thicker than a threshold thickness, similar to a pressure of fluid across the wall.

33. The separation apparatus of claim 31, wherein fluid contained within the second location of fluid is able to influence a working fluid of a motor or similar apparatus to generate movement across the wall.

34. The separation apparatus of claim 31, wherein the wall is thinner than a threshold thickness and enables easy transfer of a temperature difference across the wall.

35. The separation apparatus of claim 11, wherein the incoming volume passes from the first vessel into the separation chamber as a corresponding volume of fluid passes from the separation chamber into the first vessel for a zero net volume exchange.

36. The separation apparatus of claim 35, wherein the outgoing volume of fluid passes from the separation chamber into the second vessel as a second corresponding volume of fluid passes from the second vessel into the separation chamber for a zero net volume exchange.

37. The separation apparatus of claim 31, wherein the wall is a first wall and is thinner than a threshold thickness that enables ready transfer of temperature and the second location of fluid is otherwise contained in a second wall thicker than the threshold thickness adapted to enable a working fluid and motor or similar to operate at high pressures.

38. The separation apparatus of claim 37, wherein the first wall has a zig-zag formation to assist in transfer of temperature difference.

39. The separation apparatus of claim 38, wherein a displacer within a heat motor working fluid on an opposite side of the first wall to the second location of fluid corresponds with the zig-zag formation of the first wall.

40. The separation apparatus of claim 11, wherein there are a pair of inlets and a pair of outlets.

41. The separation apparatus of claim 11, wherein sensors are included which may be temperature sensors or pressure sensors.

42. The separation apparatus of claim 11, wherein the incoming volume of fluid and the outgoing volume of fluid are substantially equal in volume.

43. The separation apparatus of claim 42, wherein the incoming volume of fluid and the outgoing volume of fluid are exactly the same in volume.

* * * * *